US012612848B2

(12) United States Patent
Brown et al.

(10) Patent No.: US 12,612,848 B2
(45) Date of Patent: Apr. 28, 2026

(54) CENTRIFUGAL PUMP STAGE WITH RADIUSED IMPELLER FLOW PASSAGE EXIT FOR REDUCED EROSION

(71) Applicant: Halliburton Energy Services, Inc., Houston, TX (US)

(72) Inventors: Donn J. Brown, Tulsa, OK (US); Ketankumar Kantilal Sheth, Tulsa, OK (US); David McManus, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 118 days.

(21) Appl. No.: 18/748,839

(22) Filed: Jun. 20, 2024

(65) Prior Publication Data

US 2024/0384634 A1 Nov. 21, 2024

Related U.S. Application Data

(63) Continuation-in-part of application No. 18/197,373, filed on May 15, 2023.

(51) Int. Cl.
*E21B 43/12* (2006.01)
*F04D 1/06* (2006.01)
(Continued)

(52) U.S. Cl.
CPC ..... *E21B 43/128* (2013.01); *F04D 1/06* (2013.01); *F04D 13/10* (2013.01);
(Continued)

(58) Field of Classification Search
CPC ..... E21B 43/128; F04D 1/06; F04D 13/10; F04D 29/2216; F04D 29/242; F04D 29/628
See application file for complete search history.

(56) References Cited

U.S. PATENT DOCUMENTS 2,273,420 A 2/1942 Schott
4,678,399 A 7/1987 Vandevier et al.
(Continued)

FOREIGN PATENT DOCUMENTS

JP 2020197148 A 12/2020
WO 2018170002 A1 9/2018
(Continued)

OTHER PUBLICATIONS

First Office Action dated Dec. 30, 2024 (23 pages), U.S. Appl. No. 18/197,373, filed May 15, 2023.
(Continued)

*Primary Examiner* — Nicole Coy
*Assistant Examiner* — Nicholas D Wlodarski
(74) *Attorney, Agent, or Firm* — Conley Rose, P.C.; Rodney B. Carroll

(57) ABSTRACT

An electric submersible pump includes a shaft, a motor mechanically coupled to the shaft, and an impeller rotationally coupled to the shaft. The impeller includes a first hub and a first shroud. The first shroud is concentrically disposed about the first hub and has a first axial end and a second axial end. The second axial end is disposed radially outward with respect to the first axial end. A slope of an interior surface of the first shroud proximate the second axial end is within 20 degrees of being parallel to a longitudinal axis of the shaft. The impeller further includes first vanes extending from the first hub to the first shroud. The electric submersible pump further includes a diffuser fluidly coupled to the impeller. The diffuser includes a second hub, a second shroud concentrically disposed about the second hub, and second vanes extending from the second hub to the second shroud.

20 Claims, 16 Drawing Sheets

(51) Int. Cl.

| | |
|---|---|
| ***F04D 13/10*** | (2006.01) |
| ***F04D 29/22*** | (2006.01) |
| ***F04D 29/24*** | (2006.01) |
| ***F04D 29/62*** | (2006.01) |

(52) U.S. Cl.
CPC ..... *F04D 29/2216* (2013.01); *F04D 29/242* (2013.01); *F04D 29/628* (2013.01)

(56) References Cited

U.S. PATENT DOCUMENTS

| | | | | |
|---|---|---|---|---|
| 5,971,705 | A * | 10/1999 | Nagaoka | F04D 1/06 415/199.1 |
| 6,412,562 | B1 | 7/2002 | Shaw | |
| 2009/0065202 | A1 | 3/2009 | Brown et al. | |
| 2010/0319926 | A1 | 12/2010 | Reid | |
| 2014/0322001 | A1 | 10/2014 | Kushner et al. | |
| 2015/0132159 | A1 | 5/2015 | Wilson et al. | |
| 2015/0204336 | A1* | 7/2015 | McManus | F04D 29/0413 415/203 |
| 2017/0051752 | A1* | 2/2017 | Gahlot | F04D 29/628 |
| 2017/0122333 | A1 | 5/2017 | Gray et al. | |
| 2017/0241424 | A1 | 8/2017 | Patil et al. | |
| 2018/0291907 | A1 | 10/2018 | Ye et al. | |
| 2019/0017518 | A1 | 1/2019 | Brown et al. | |
| 2019/0024665 | A1 | 1/2019 | Ashurst et al. | |
| 2019/0040863 | A1 | 2/2019 | Davis et al. | |
| 2019/0162063 | A1 | 5/2019 | Brown et al. | |
| 2020/0347849 | A1 | 11/2020 | Ye et al. | |
| 2021/0140290 | A1 | 5/2021 | Eslinger et al. | |
| 2024/0384634 | A1 | 11/2024 | Brown et al. | |

FOREIGN PATENT DOCUMENTS

| | | | |
|---|---|---|---|
| WO | 2019165164 | A | 8/2019 |
| WO | 2021055689 | A1 | 3/2021 |
| WO | 202312024 | A1 | 2/2023 |

OTHER PUBLICATIONS

Foreign Communication from Related Application—International Search Report and Written Opinion of the International Searching Authority, International Application No. PCT/US2023/023186, dated Feb. 14, 2024, 12 pages.

Filing Receipt, Specification and Drawings for U.S. Appl. No. 18/197,373, entitledHigher Work Output Centrifugal Pump Stage, filed May 15, 2023, 52 pages.

Foreign Communication from Related Application—International Search Report and Written Opinion of the International Searching Authority, International Application No. PCT/US2025/013164, dated May 14, 2025, 13 pages.

Final Office Action dated Apr. 7, 2025 (26 pages), U.S. Appl. No. 18/197,373, filed May 15, 2023.

* cited by examiner

CENTRIFUGAL PUMP STAGE WITH RADIUSED IMPELLER FLOW PASSAGE EXIT FOR REDUCED EROSION

CROSS-REFERENCE TO RELATED APPLICATIONS

This application is a continuation-in-part of and claims priority to U.S. patent application Ser. No. 18/197,373, filed May 15, 2023, the entire contents of which are incorporated herein by reference.

STATEMENT REGARDING FEDERALLY SPONSORED RESEARCH OR DEVELOPMENT

Not applicable.

BACKGROUND

Centrifugal pumps may be used in a wide variety of applications including electric submersible pumps (ESPs) and in horizontal pump systems (HPSs). ESPs may be disposed downhole in a wellbore to lift production fluid in the wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate. HPSs may be disposed in a horizontal position at the surface and may provide pumping pressure to fluids to cause these fluids to flow, for example to flow in a pipeline.

Conventional centrifugal pumps operating in harsh environments such as with heavy concentrations of sand suspended in the liquid may be subject to premature failure due to erosion. Radial slinging of the sand laden liquid by the impeller may cause erosion of the walls of the stationary diffuser at the initial contact point. This type of centrifugal sandblasting may erode the wall of the diffuser rapidly and thus causes premature failure of the pump.

The centrifugal pump of the present disclosure may reduce erosion and extend life as compared with conventional centrifugal pumps.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
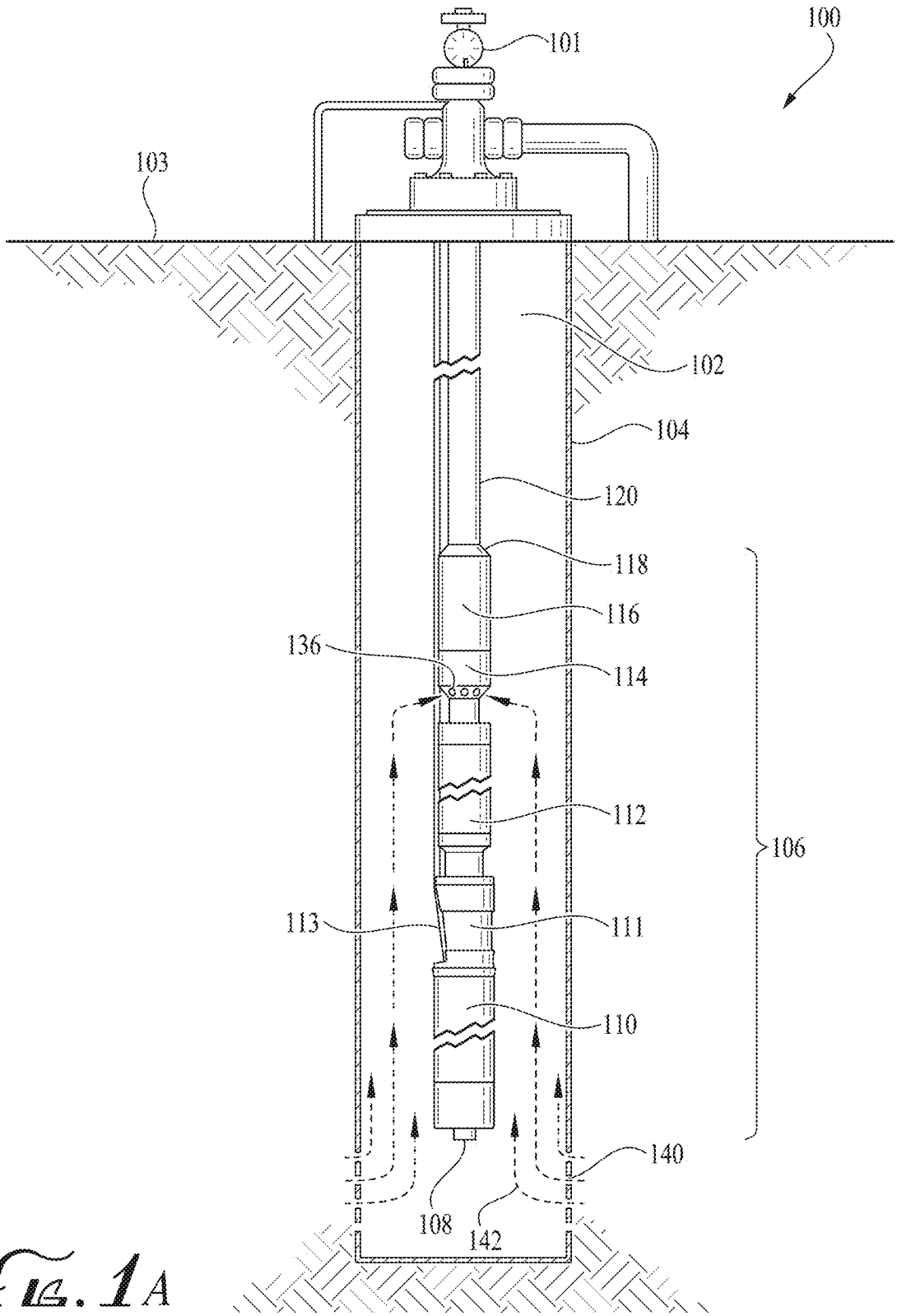
FIG. 1A is an illustration of a completion string disposed in a wellbore according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

The present disclosure relates to a centrifugal pump stage with a radiused impeller flow passage exit for reduced erosion. The pump stage can be used in a centrifugal pump assembly in an electric submersible pump (ESP) assembly or in a horizontal pump system (HPS). This pump stage structure may also be used in other environments besides the ESP assembly and HPS. The centrifugal pump stage according to the present disclosure may offer the advantage over conventional pump stages in that erosion is comparatively less. For example, in conventional pumps, the flow passage exit of the impeller may direct flow into the diffuser such that high velocity fluid with sand particles impinges at an angle onto the wall of the diffuser. That is, particles may be carried by the fluid at high speed towards the wall of the diffuser and then impact on the wall due to their inertia. This may lead to rapid erosion and premature failure of the conventional pump, especially if the conventional pump is run fast or there is a high concentration of sand particles in the fluid. The pump stage according to the present disclosure may include a radiused impeller flow passage exit that may gently transition the flow direction from an approximately radial direction to an approximately axial direction even before the flow reaches the diffuser, thus reducing erosion of the diffuser. Because of this reduced erosion, the pump stage of the present disclosure may significantly outlast the conventional pump stage.

Referring to FIG. 1A an exemplary well site environment 100 is shown. The well site environment 100 may include a wellbore 102 that is at least partially cased with casing 104. The wellbore 102 may be substantially vertical, but the electric submersible pump (ESP) assembly 106 described herein also may be used in a wellbore 102 that has a deviated or horizontal portion. The well site environment 100 may be at an on-shore location or at an off-shore location. In some embodiments, the ESP assembly 106 may include a sensor package 108, an electric motor 110, a motor head 111 that couples the electric motor 110 to a seal unit 112, a fluid intake 114 having inlet ports 136, and/or a centrifugal pump assembly 116. The centrifugal pump assembly 116 may include centrifugal pump stages.

In some embodiments, the electric motor 110 may be replaced by a hydraulic turbine, a pneumatic turbine, a hydraulic motor, or an air motor. In some embodiments, the ESP assembly 106 may further include a gas separator assembly that may be located between the fluid intake 114 and the centrifugal pump assembly 116. In some embodiments, the fluid intake 114 may be integrated into a downhole end of the gas separator. In some embodiments, the fluid intake 114 may be integrated into a downhole end of the centrifugal pump assembly 116.

The centrifugal pump assembly 116 may be coupled to a production tubing 120 via a connector 118. An electric cable 113 may attach to the electric motor 110 and extend to the surface 103 to connect to an electric power source. In some embodiments where the electric motor 110 is replaced by a hydraulic turbine or a hydraulic motor, the electric cable 113 may be replaced by a hydraulic power supply line. In some embodiments where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102.

In some embodiments, the ESP may have a bottom-intake design in which the fluid intake 114 may be located at the downhole end of the ESP assembly 106, the centrifugal pump assembly 116 may be located uphole of the fluid intake 114, the motor 110 may be located uphole of the centrifugal pump assembly 116, and/or the seal section 112 may be located uphole of the motor 110. For example, in a through-tubing-conveyed completion, the order of placement of components of the ESP assembly 106 may be altered in various ways, for example with the fluid intake located at the downhole end of the ESP assembly 106, the centrifugal pump assembly 116 located uphole of the fluid intake 114, the seal section 112 located uphole of the centrifugal pump assembly 116, and the motor 110 located uphole of the seal section 112.

The well fluid 142 may flow uphole in the wellbore 102 towards the ESP assembly 106, in the inlet ports 136, and into the fluid intake 114. The well fluid 142 may comprise a liquid phase fluid, or the well fluid 142 may comprise a gas phase fluid mixed with a liquid phase fluid. Under normal operating conditions (e.g., well fluid 142 is flowing out of the perforations 140, the ESP assembly 106 may be energized by electric power, and the electric motor 110 may be turning), the well fluid 142 may enter the inlet ports 136 of the fluid intake 114 and flow into the centrifugal pump assembly 116. The centrifugal pump assembly 116 may cause the fluid to flow through the connector 118 and up the production tubing 120 to a wellhead 101 at the surface 103. The centrifugal pump assembly 116 may provide pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water.

Figure 1B:
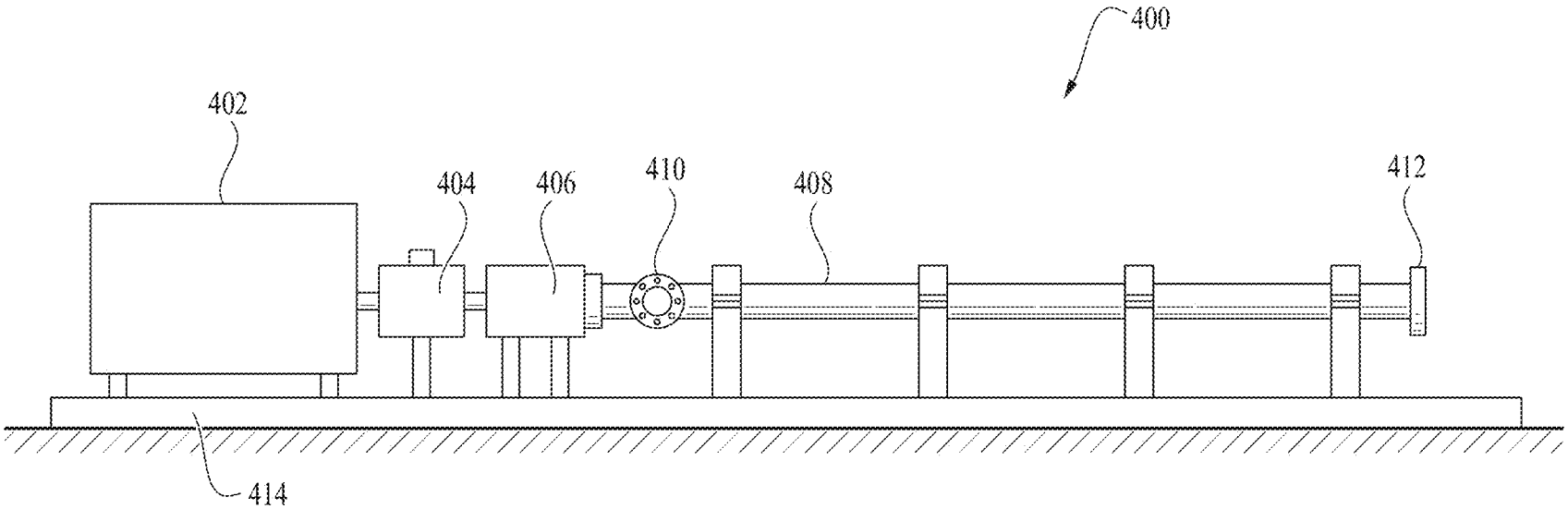
FIG. 1B is an illustration of a horizontal pump system (HPS) according to an embodiment.

Referring to FIG. 1B, an exemplary horizontal pumping system (HPS) 400 is shown. In some embodiments, the HPS 400 comprises a motor 402, a rotational coupling 404, a mechanical seal 406, and/or a centrifugal pump assembly 408. In some embodiments, a fluid inlet 410 is integrated into a first end of the centrifugal pump assembly 408 and/or a fluid outlet 412 is integrated into a second end of the centrifugal pump assembly 408. The motor 402, the rotational coupling 404, the mechanical seal 406, and/or the centrifugal pump assembly 408 may be mounted on a skid 414 for easy transportation to a location on a truck. The skid 414 may be placed on the ground at the location. The centrifugal pump assembly 408 may be the centrifugal pump assembly 116 described above with reference to FIG. 1A, may contain and/or include the centrifugal pump assembly 116, and/or may have similar components as the centrifugal pump assembly 116.

The motor 402 may be an electric motor, a hydraulic turbine, or an air turbine. When the motor 402 turns, the drive shaft of the centrifugal pump assembly 408 may turn, thereby turning the impellers of the centrifugal pump assembly 408. The torque provided by the motor 402 may be transferred via the rotational coupling 404 to the drive shaft of the centrifugal pump assembly 408.

The HPS 400 may be deployed for use in a variety of different surface operations. The HPS 400 can be used as a crude oil pipeline pressure and/or flow booster. The HPS 400 can be used in a mine dewatering operation (e.g., removing water from a mine). The HPS 400 can be used in geothermal energy applications, for example, to pump geothermal water from a wellhead through a pipe to an end-use or energy conversion facility. The HPS 400 can be used in carbon sequestration operations. The HPS 400 can be used in salt water disposal operations, for example receiving salt water from a wellbore and pumping the salt water under pressure down into a disposal well. The HPS 400 can be used in desalinization operations.

Figure 2:
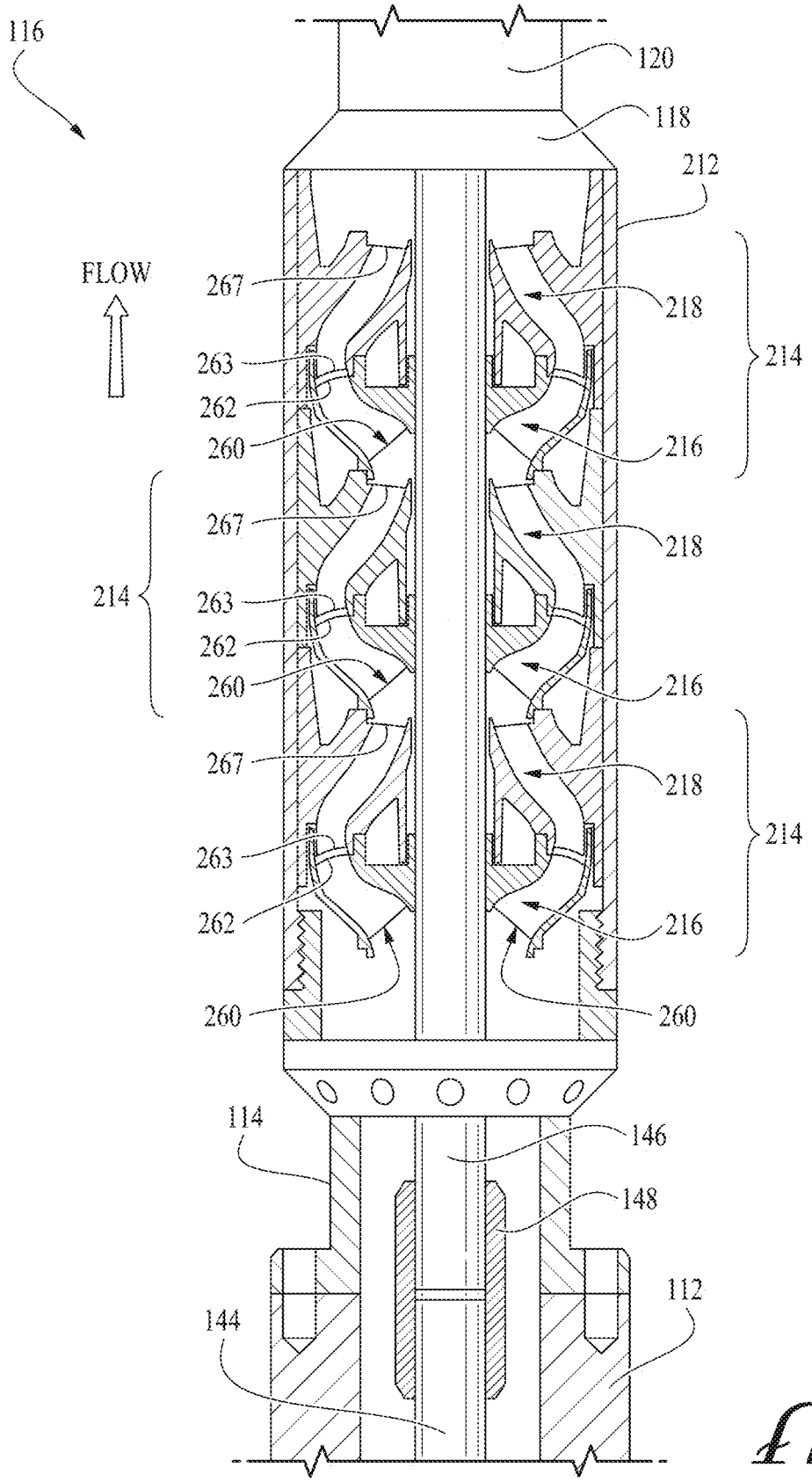
FIG. 2 is a cross-sectional side view of a centrifugal pump assembly according to an embodiment.

Referring to FIG. 2, an exemplary centrifugal pump assembly 116 is shown. The centrifugal pump assembly 116 may include pump stages 214 enclosed within a housing 212. For ease of illustration, three pump stages 214 are illustrated in FIG. 2, however, any number of pump stages 214 may be used. For example, one, two, four, five, six, seven, eight, nine, ten, eleven, twelve or more pump stages 214 may be used. Each pump stage 214 may include an impeller 216 and a diffuser 218. The impeller 216 and the diffuser 218 may be mated, concentrically aligned, and/or fluidly coupled. Impeller 216 has several vanes that connect the impeller hub 250 and impeller shroud 252. Leading edge of the vane may be straight, concave or convex shape based on the impeller geometry. A trailing edge 262 of a vane of the impeller 216 may be disposed proximate to a leading edge 263 of a vane of the diffuser 218. There may be a gap between the trailing edge 262 and the leading edge 263. A leading edge 260 of a vane of the impeller 216 may be disposed proximate to a trailing edge 267 of a vane of the diffuser 281. There may be a gap between the leading edge 260 and the trailing edge 267. In some embodiments, the leading edges 260, 263 and the trailing edges 262, 267 are curved. In some embodiments, the leading edges 260, 263 and the trailing edges 262, 267 are straight. In some embodiments, a radially innermost point of the leading edge 260 is disposed downstream of a radially outermost point of the leading edge 260; a radially innermost point of the leading edge 263 is disposed downstream of the a radially outermost point of the leading edge 263; a radially innermost point of the trailing edge 262 is disposed downstream of a radially outermost point of the trailing edge 262; and/or a radially innermost point of the trailing edge 267 is disposed downstream of a radially outermost point of the trailing edge 267.

A drive shaft 144 of the seal section 112 may be coupled to a drive shaft of the electric motor 110 and receive rotational power from the drive shaft of the electric motor 110. An uphole end of the drive shaft 144 of the seal section 112 may be coupled via a coupling shell 148 to a downhole end of a drive shaft 146 of the centrifugal pump assembly 116. The impellers 216 may be coupled to the drive shaft 146 (e.g., via a key inserted into keyways defined in the drive shaft and in the inside of the impeller 216), and/or the diffusers 218 may be retained by the housing 212. In some embodiments, the pump stages 214 may be disposed uphole with respect to the seal section 112.

Figure 3A:
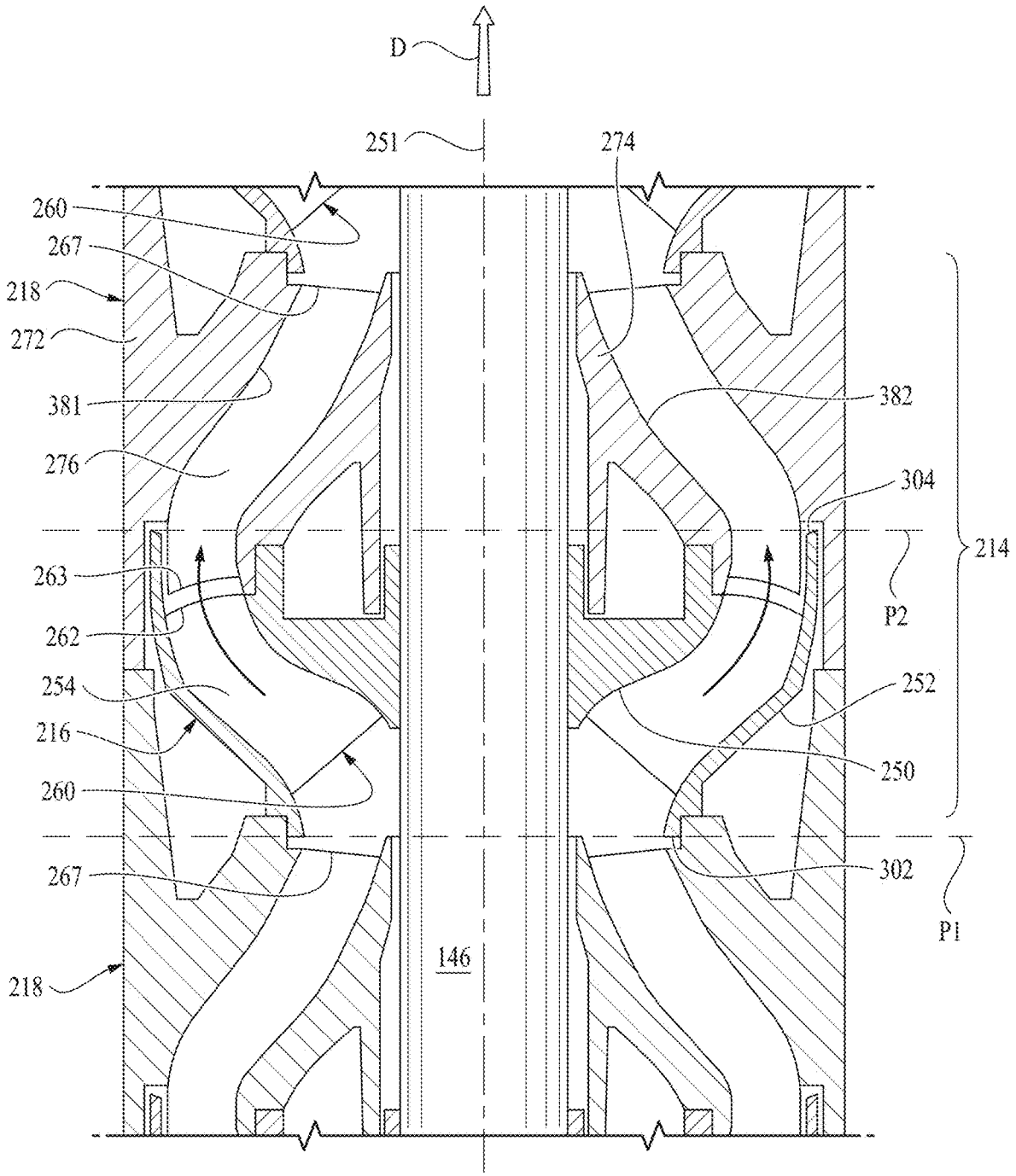
FIG. 3A is a cross-sectional side view of the impeller and the diffuser of the centrifugal pump assembly of FIG. 2.
Figure 3B:
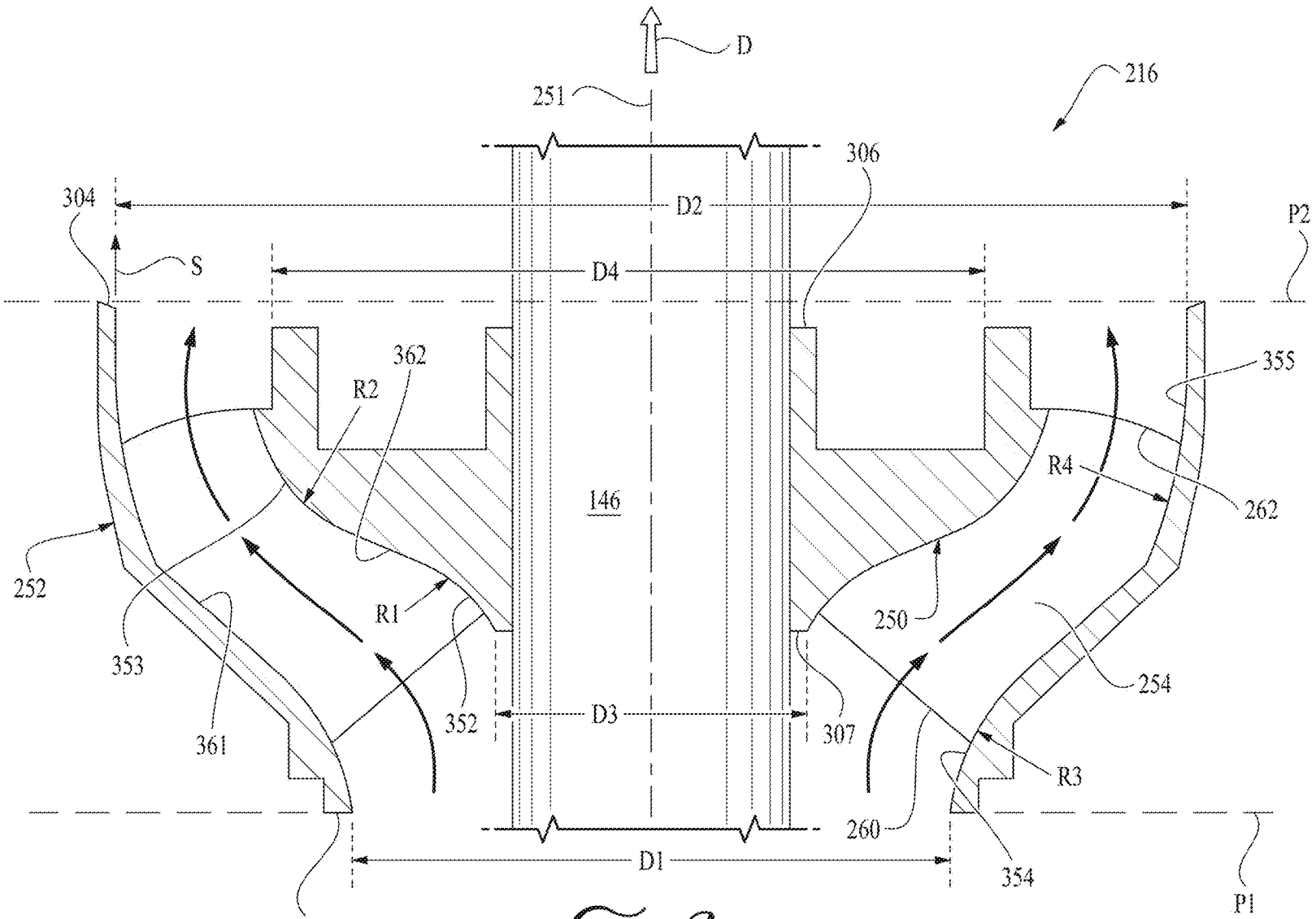
FIG. 3B is a cross-sectional side view of the impeller of the centrifugal pump assembly of FIG. 2.
Figure 3C:
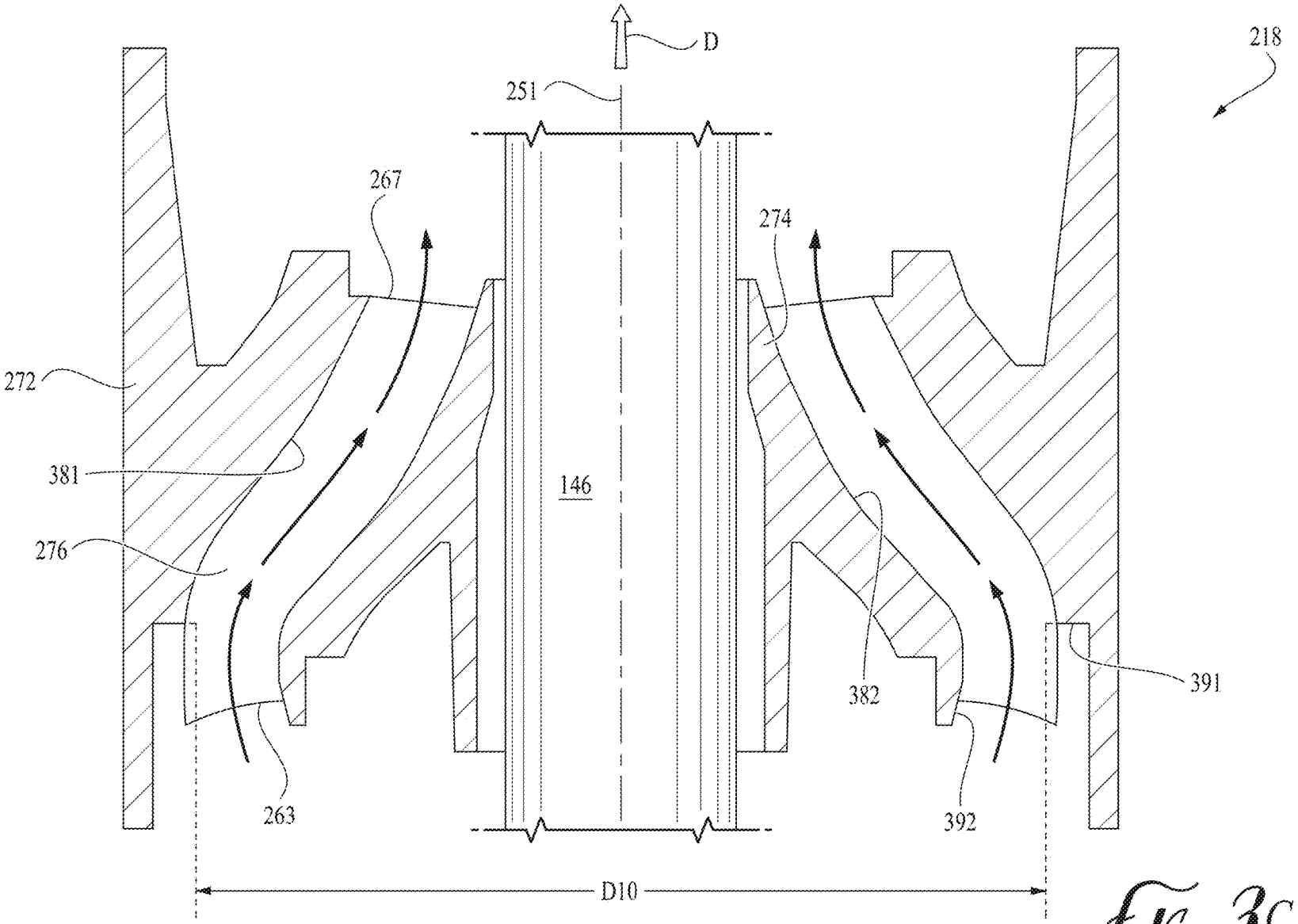
FIG. 3C is a cross-sectional side view of the diffuser of the centrifugal pump assembly of FIG. 2.

Referring to FIGS. 3A, 3B and 3C, the impeller 216 and the diffuser 218 of the exemplary ESP assembly 116 are shown in more detail. The impeller 216 may be rotationally coupled to the shaft 146 (e.g., driven by a motor mechanically coupled to the shaft 146). The impeller 216 may include a first hub 250 and a first shroud 252 concentrically disposed about the first hub 250 and comprising a first axial end 302 and a second axial end 304. The second axial end 304 may be disposed radially outward with respect to the first axial end 302. For example, a radially innermost point of the second axial end 304 may be disposed radially outward with respect to a radially innermost point of the first axial end 302. A slope of an interior surface of the first shroud 252 proximate the second axial end 304 may be parallel to a longitudinal axis 251 of the shaft 146. In some embodiments, the slope of the interior surface of the first shroud 252 proximate (e.g., within 1 mm, 2 mm, 3 mm, 5 mm, 10 mm, or 20 mm of) the second axial end 304 is within 1 degree, 2 degrees, 5 degrees, 10 degrees, 12 degrees, 15 degrees, 20 degrees, or 30 degrees of being parallel to a longitudinal axis 251 of the shaft 146. The diffuser 218 may be fluidly coupled to the impeller 216. The diffuser 218 may include a second hub 274 and a second shroud 272 concentrically disposed about the second hub 274. Vanes 254 of the impeller 216 may mechanically join the first hub 250 and the first shroud 252. Vanes 276 of the diffuser may mechanically joint the second hub 274 and the second shroud 272.

Figure 5:
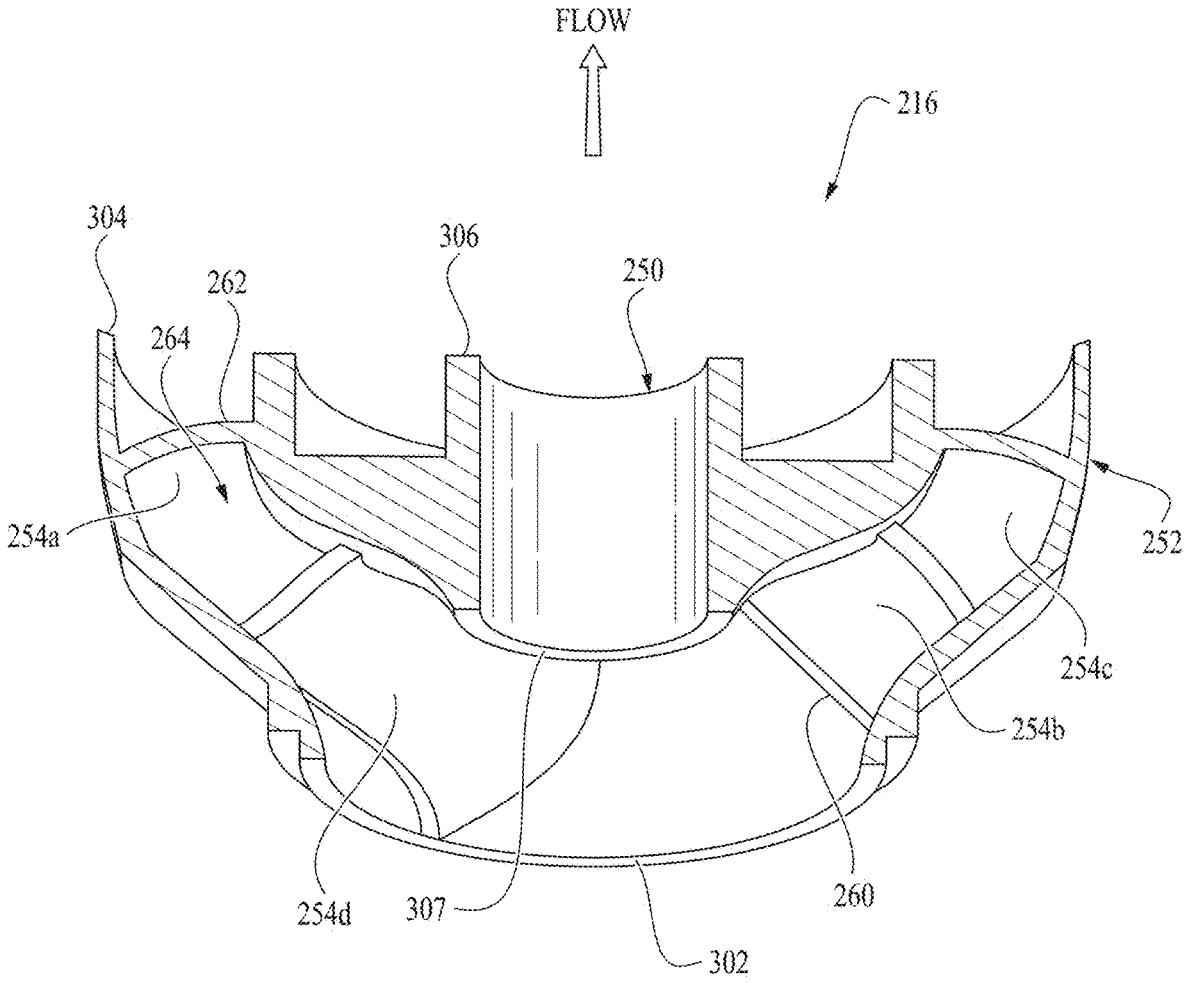
FIG. 5 is cross-sectional perspective view of the impeller of the centrifugal pump assembly of FIG. 2.
Figure 6:
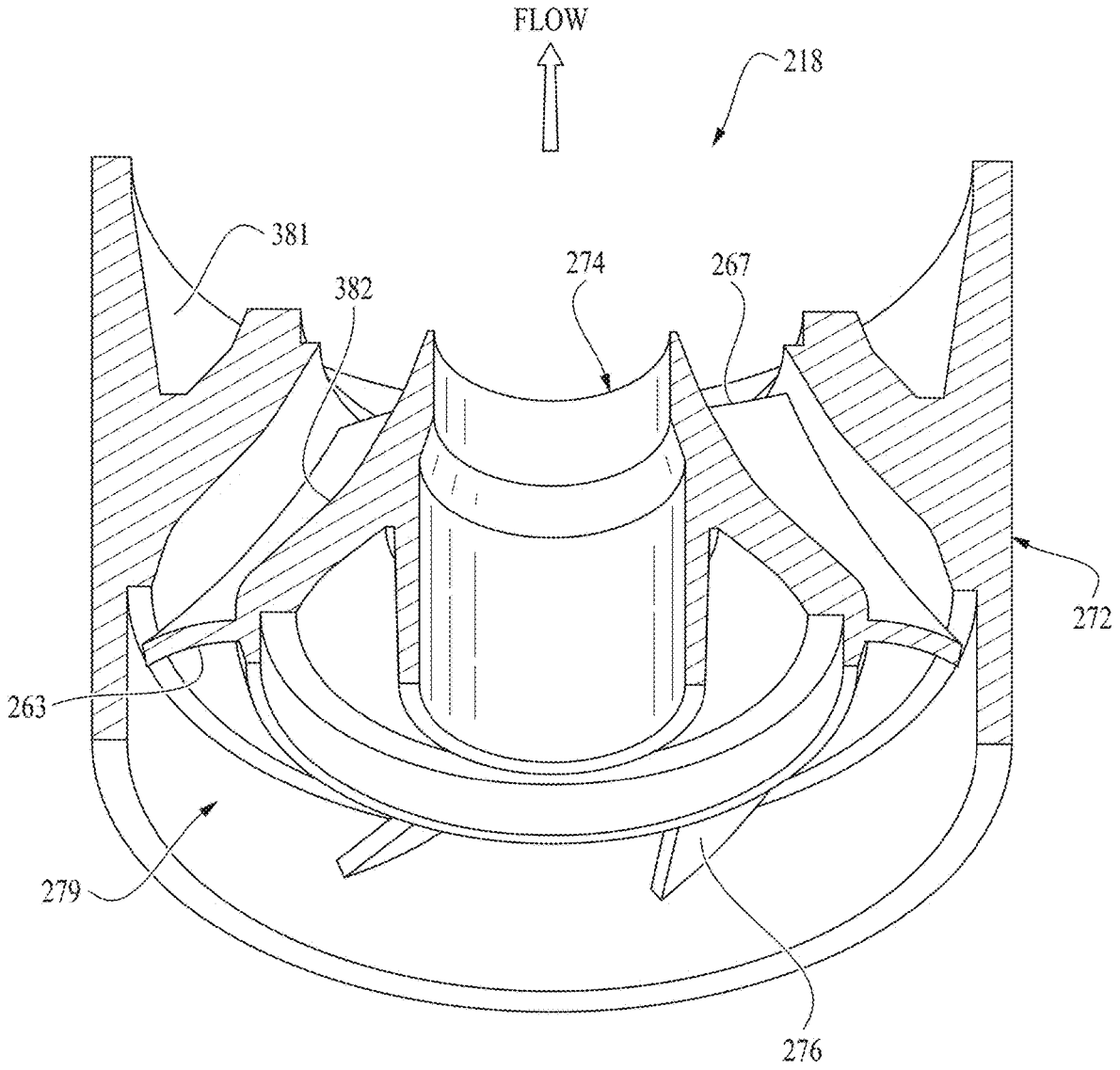
FIG. 6 is a cross-sectional perspective view of the diffuser of the centrifugal pump assembly of FIG. 2.

The impeller 216 may be configured to rotate with respect to the diffuser 218, which may be stationary. The impeller 216 may be concentrically disposed with respect to the diffuser 218. The second axial end 304 may be disposed farther in a direction D parallel to the longitudinal axis 251 (as shown in FIGS. 3A and 3B) than the first axial end 302. The second axial end 304 may be disposed farther in the direction D than a trailing edge 262 (e.g., a trailing edge 262 of vanes 254 of the impeller 216 as shown in FIG. 5). The second axial end 304 may be disposed farther in the direction D than a leading edge 263 (e.g., a leading edge 263 of vanes 276 of the diffuser 218 as shown in FIG. 6). The second axial end 304 of the first shroud 252 may be disposed on a second virtual plane P2 perpendicular to the longitudinal axis 251. The first hub 250 may have a first axial end 307 and a second axial end 306. The second axial end 306 of the first hub 250 may be disposed on or proximate to the second virtual plane P2. The second axial end 306 of the first hub may be disposed between the second virtual plane P2 and a first virtual plane P1 that the first axial end 302 of the first shroud 252 is disposed on and that is perpendicular to the longitudinal axis 251. That is, the first shroud 252 may extend beyond the first hub 250 in the direction D. The leading edge 263 of the diffuser 218 may be disposed proximate to the trailing edge 262 of the impeller 252. A profile of the leading edge 263 may correspond in shape with a profile of the trailing edge 262. The leading edge 263 and/or the trailing edge 262 may be disposed between the first virtual plane P1 and the second virtual plane P2. The impeller 216 may be disposed inside a volume defined by the diffuser 218 and another diffuser 218. The first hub 250 may be disposed at least partially inside the second hub 274. The first shroud 252 may be disposed at least partially inside the second shroud 272.

The hub 250 may have an exterior surface 362 having a concave portion 352 and a convex portion 353. Alternatively, portion 353 may be a straight conical shape. Sometime concave portion 352 and convex portion 353 may be joined by a straight conical surface. The concave portion 352 may be disposed between the first axial end 307 and the convex portion 353. The convex portion 353 may be disposed between the second axial end 306 and the concave portion 352. The concave portion 352 may have a first radius of curvature R1, and the convex portion 353 may have a second radius of curvature R2. The second radius of curvature R2 may be greater than the first radius of curvature R1. The shroud 252 may have an interior surface 361 having a convex portion 354 and a concave portion 355. The concave portion 355 may be disposed between the convex portion 354 and the second axial end 304. The convex portion 354 may be disposed between the concave portion 355 and the first axial end 302. The convex portion 354 may have a third radius of curvature R3, and the concave portion 355 may have a fourth radius of curvature R4. The fourth radius of curvature R4 may be larger than the third radius of curvature R3. Alternatively, concave portion 361 and convex portion 355 may be joined by a straight conical surface. The interior surface 361 of the shroud 252 and the exterior surface 362 of the hub 250 may define a flow passage. The flow passage may be further defined by surfaces of the vanes 254. The direction of flow within the flow passage may be from the first virtual plane P1 to the second virtual plane P2. In some embodiments, an inner diameter D1 of the shroud 252 at the first axial end 302 of the shroud 252 is smaller than an inner diameter D2 of the shroud 252 at the second axial end 304 of the shroud 252. In some embodiments, an outer diameter D3 of the hub 250 at the first axial end 307 of the hub 250 is less than an outer diameter D4 of the hub 250 at the second axial end 306 of the hub 250.

The inner surface 361 of the shroud 252 may slope radially outward proximate the first axial end 302. The slope of the inner surface 361 of the shroud 252 in the radially outward direction may increase and then decrease moving from the first axial end 302 towards the second axial end 304. Proximate the second axial end 304, the slope may be parallel to the longitudinal axis 251 of the shaft 146 or approximately parallel to the longitudinal axis 251 of the shaft 146. In some embodiments, the shroud 252, the hub 250, and the shaft 146 share a common longitudinal axis 251. The exterior surface 362 of the hub 250 may slope radially outward proximate the first axial end 307. The slope of the exterior surface 362 of the hub 250 in the radially outward direction may increase and then decrease moving from the first axial end 307 towards the second axial end 306. In some embodiments, the second axial end 304 of the first shroud 252 is disposed farther than the second axial end 306 of the first hub 250 in the direction D. In some embodiments, the second axial end 306 of the first hub 250 is disposed farther than the second axial end 304 of the first shroud 252 in the direction D. In some embodiments, both the second axial end 304 of the first shroud 252 and the second axial end 306 of the first hub 250 are disposed the same distance in the direction D.

In some embodiments, the first hub 250 comprises a trident-shaped cross section. The hub 274 of the diffuser 218 may abut and/or be fastened to the hub 250 of the impeller 216. The second virtual plane P2 may intersect the first hub 250. Two adjacent diffusers 218 may abut and/or be fastened to one another and contain within them the impeller 216. The impeller 216 may rotate while the diffusers 218 remain stationary. In some embodiments, the second axial end 304 of the first shroud 252 of the impeller 216 abuts the shroud 272 of the diffuser 218. In some embodiments, the second axial end of the first hub 250 of the impeller 216 abuts the hub 274 of the diffuser 218. The second shroud 272 of the diffuser 218 may comprise an interior surface 381, and the second hub 274 of the diffuser 218 may comprise an exterior surface 382. The interior surface 381 may form a U-shape and/or a parabola-shape with the interior surface 361. The exterior surface 382 may form a U-shape and/or a parabola-shape with the exterior surface 362.

The leading edge 263 may be disposed between the first axial end 302 and the second axial end 304 of the first shroud 252. The leading edge 263 may be disposed between the interior surface 361 of the first shroud 252 and the exterior surface 362 of the first hub 250. The leading edge 263 of the diffuser 218 may be a taper edge start from the edge 391 extending away from the direction D ending on the diameter 392 of the hub 382 of the diffuser 218. The leading edge 263 may be disposed between the first virtual plane P1 and the second virtual plane P2. The trailing edge 262 may be disposed between the first axial end 302 and the second axial end 304 of the first shroud 252. The trailing edge 262 may be disposed between the interior surface 361 of the first shroud 252 and the exterior surface 362 of the first hub 250. The trailing edge 262 may be disposed between the first virtual plane P1 and the second virtual plane P2. Inner Diameter D2 of the impeller 216 (as shown in FIG. 3B) is larger than the outer diameter D10 of the vane 263 of the diffuser 218 (as shown in FIG. 3C).

By virtue of the shape of the shroud 272 and its elongated nature, the shroud 272 may act as an effective erosion barrier. The smoothness of the curve of the shroud 272 (e.g., the third radius of curvature R3 and/or the fourth radius of curvature R4) and/or the slope S being approximately parallel to the longitudinal axis 251 at the second axial end 304 may allow mixed flow (i.e., flow with a non-negligible axial component and a non-negligible radial component) to gently transition to axial flow (i.e., flow in the axial direction with a negligible radial component) at a location within the impeller 216. In other words, the flow of the fluid may be in the axial direction when the fluid exits the impeller 216 and enters the diffuser 218. An inflection point at which radially outward flow transitions to radially inward flow may occur proximate to the second axial end 304 of the first shroud 252 of the impeller 216. The inflection point may be within 1 mm, 2 mm, 3 mm, 4 mm, 5 mm, 10 mm, or 15 mm of the second axial end 304. In some embodiments, the inflection point occurs before the second axial end 304 (i.e., the second axial end 304 is disposed farther in the direction D than the inflection point). In some embodiments, the inflection point occurs between the first virtual plane P1 and the second virtual plane P2. In some embodiments, the inflection point occurs inside the volume between the interior surface 361 of the shroud and the exterior surface 362 of the hub 250. In some embodiments, the inflection point occurs at or proximate to the concave portion 355 of the interior surface 361 of the shroud 252. In some embodiments, the inflection point is caused at least in part due to the fourth radius of curvature R4 of the concave portion 355. As used herein, the terms "axial" and "radial" may be in relation to the impeller 216, the shaft 146, and/or longitudinal axis 251. In some embodiments, radially outward flow means that an average velocity of flow at a location in the flow passage points away from the longitudinal axis 251. In some embodiments, radially inward flow means that an average velocity of flow at a location in the flow passage points towards the longitudinal axis 251.

Figure 12:
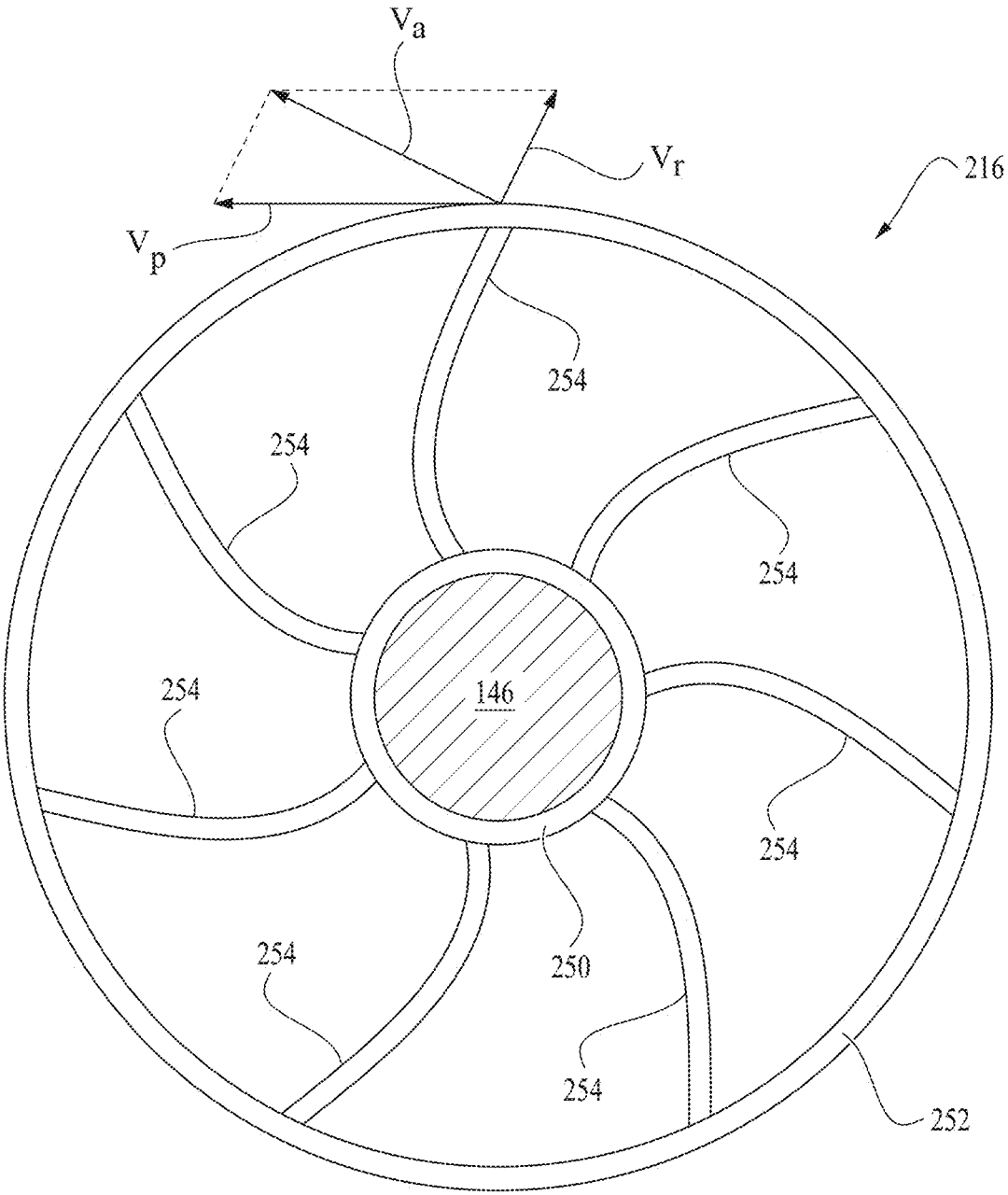
FIG. 12 is a schematic diagram of flow velocities of fluid inside the impeller, according to an embodiment.

Referring to FIG. 12, more detail about the fluid dynamics that occur within the centrifugal pump stage 214 is shown. Without wishing to be bound by any theory, fluid upstream of the point of transition from radially outward flow to axial flow has two components of velocity in the horizontal plane: relative velocity $V_r$, which is velocity of the fluid tangent to the impeller vanes 254; and peripheral velocity $V_p$, which is velocity of the fluid tangent to the impeller shroud 252. Absolute velocity $V_a$, which is the overall velocity of the fluid, can be obtained by adding the vectors of relative velocity $V_r$ and peripheral velocity $V_p$. In general, wear on a component due to sandblasting is proportional to the cube of the velocity of fluid impinging on such a component. If, as in the conventional art, the point of transition from radially outward flow to axial flow were to occur in the diffuser, the shroud of the diffuser would experience the absolute velocity $V_a$ of the fluid. This is because the shroud of the diffuser is stationary. However, because of the unique geometry of the centrifugal pump stage 214 of the present disclosure, the point of transition from radially outward flow to axial flow occurs in the impeller 216. Due to its rotation, the shroud 252 of the impeller 216 moves at the same velocity as the peripheral velocity $V_p$, and thus the shroud 252 of the impeller 216 only experiences the relative velocity $V_r$. Because the relative velocity $V_r$ is less than the absolute velocity $V_a$, the centrifugal pump stage 214 of the present disclosure would experience less erosion as compared with the conventional art.

Figure 4:
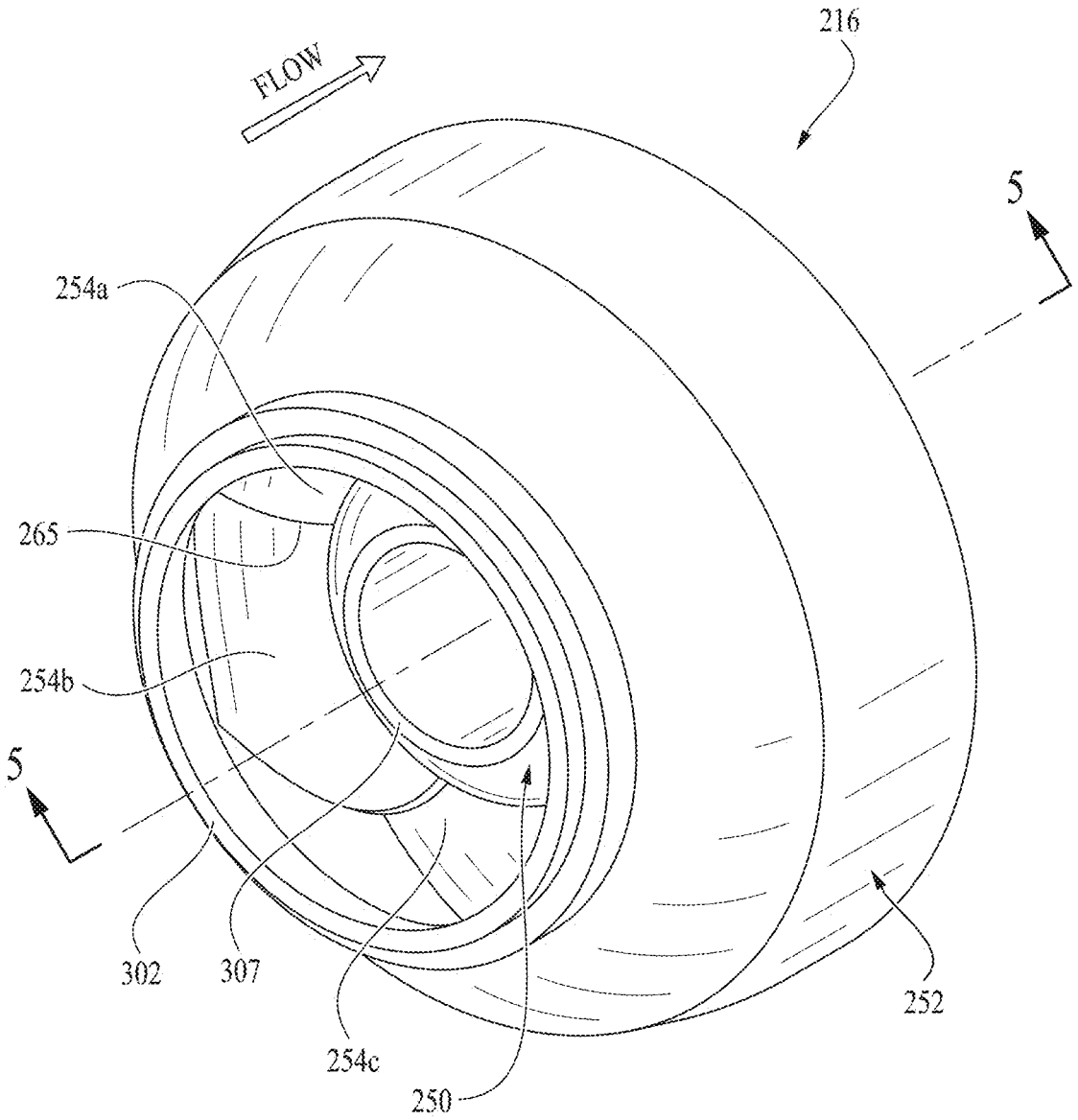
FIG. 4 is a perspective view of the impeller of the centrifugal pump assembly of FIG. 2.

Referring to FIGS. 4-5, further details of the impeller 216 are shown. In some embodiments, the impeller 216 is made of metal. In some embodiments, the impeller 216 is manufactured in a casting process. In some embodiments, the impeller 216 is manufactured using a three-dimensional (3D) printing process. In some embodiment, the impeller 216 includes a first impeller vane 254*a*, a second impeller vane 254*b*, a third impeller vane 254*c*, and a fourth impeller vane 254*d*. In some embodiments, the impeller 216 comprises only three impeller vanes 254. In some embodiments, the impeller 216 may comprise five impeller vanes 254, six impeller vanes 254, seven impeller vanes 254, eight impeller vanes 254, nine impeller vanes 254, ten impeller vanes 254, or more. The vanes 254 may extend from the first hub 250 to the first shroud 252. The inside of the first hub 250 may be a keyway that may be aligned with a keyway in the drive shaft 146 of the centrifugal pump assembly 116, and/or the impellers 216 may be coupled to the drive shaft 146 of the centrifugal pump assembly 116 by inserting a key into the aligned keyways of the hub 250 and the drive shaft 146 of the centrifugal pump assembly 116.

The impeller vanes 254 may have a leading edge 260 and a trailing edge 262. The leading edge 260 may extend from the first hub 250 to the first shroud 252. In some embodiments, the leading edge 260 is cupped or curved downhole slightly. For example, if a line were drawing between the points where the leading edge 260 connects with the first shroud 252 and where the leading edge 260 connects with the first hub 250, a middle point along the leading edge 260 would be disposed off this line on a downhole side of the line. The impeller 216 may define flow passages 264 between the first hub 250, the first shroud 252, and the impeller vanes 254.

Referring to FIG. 6, further details of the diffuser 218 are shown. In some embodiments, the diffuser 218 is made of metal. In some embodiments, the diffuser 218 is manufactured in a casting process. In some embodiments, the diffuser 218 is manufactured using a three-dimensional (3D) printing process. The diffuser 218 may include a second shroud 272 and a second hub 274. The second shroud 272 may have a substantially straight-walled cylinder structure. The diffuser 218 may include diffuser vanes 276, where a leading edge 263 of the vanes 276 may extend from the second hub 274 to the second shroud 272. In some embodiments, the diffuser 218 may have fewer diffuser vanes 276 than the number of vanes 254 of the impeller 216, an equal number of diffuser vanes 276 as the number of vanes 254 of the impeller 216, or a greater number of diffuser vanes 276 than the number of vanes 254 of the impeller 216. In some embodiments, the diffuser 218 has three diffuser vanes 276, four diffuser vanes 276, five diffuser vanes 276, six diffuser vanes 276, seven diffuser vanes 276, eight diffuser vanes 276, nine diffuser vanes 276, ten diffuser vanes 276, eleven diffuser vanes 276, twelve diffuser vanes 276, or more. The diffuser 218 may have a flow passageway 279 between the second hub 274, the second shroud 272, and the vanes 276.

Figure 7A:
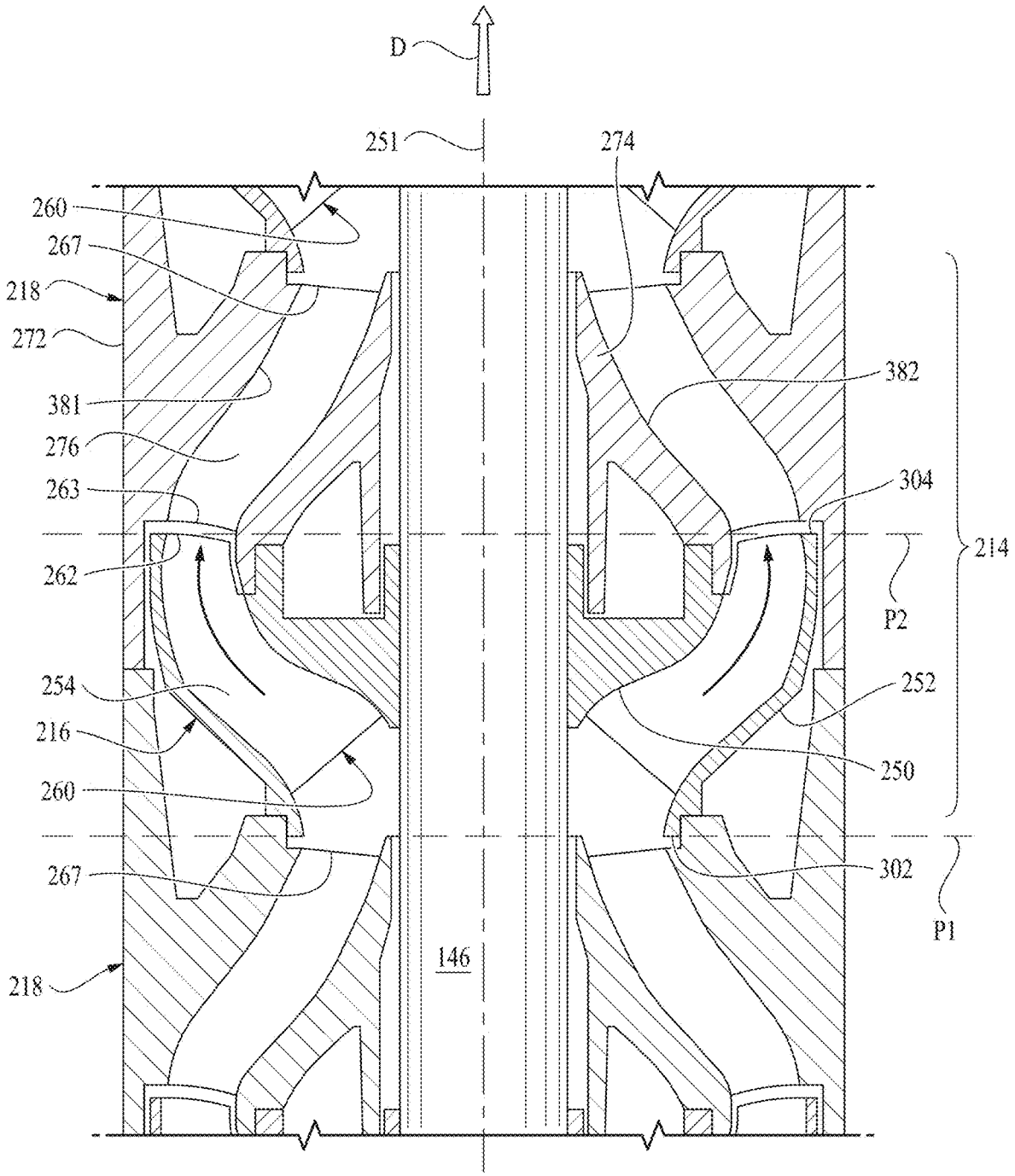
FIG. 7A is a cross-sectional side view of the impeller and the diffuser according to another embodiment.
Figure 7B:
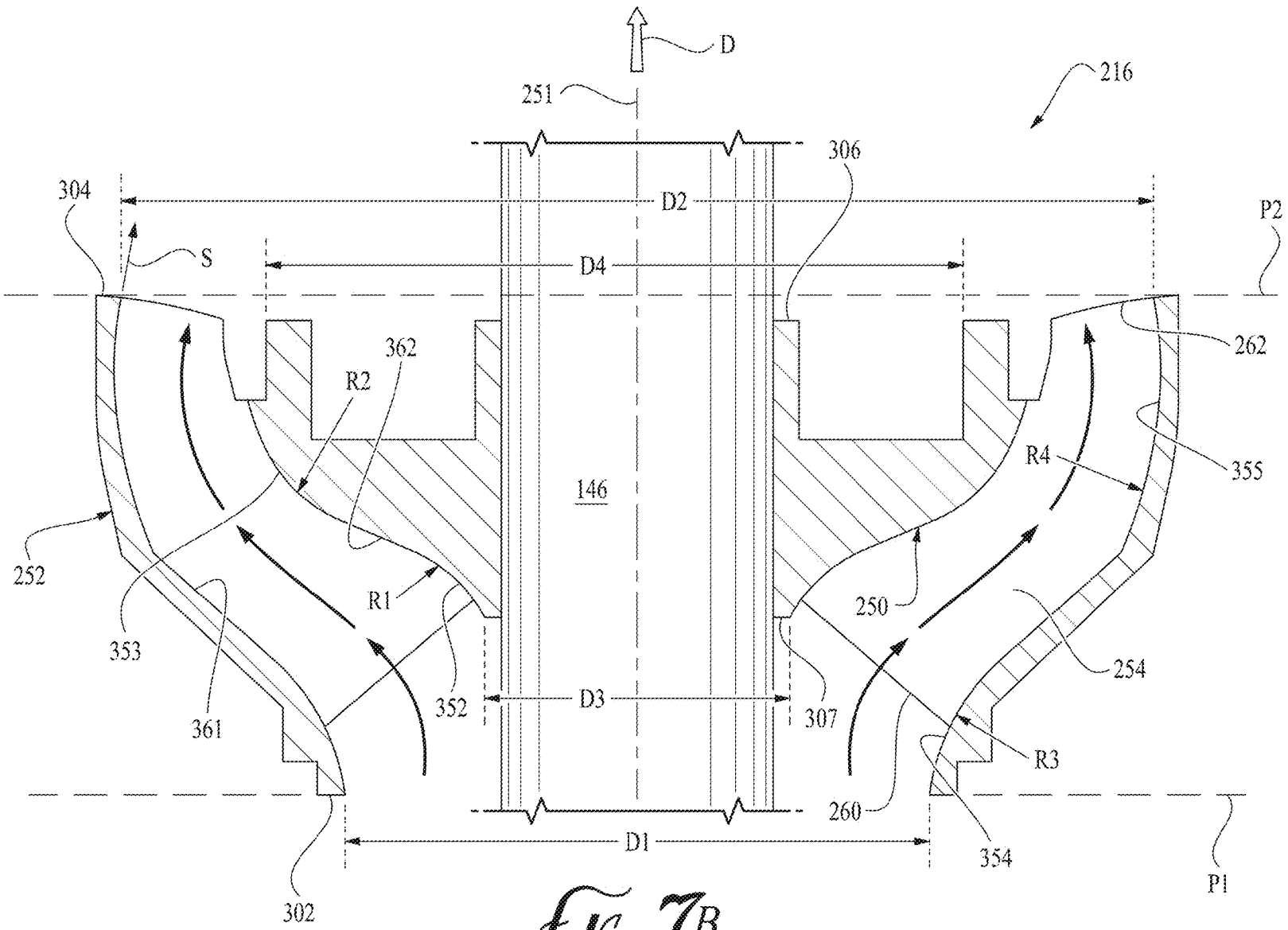
FIG. 7B is a cross-sectional side view of the impeller of FIG. 7A.
Figure 7C:
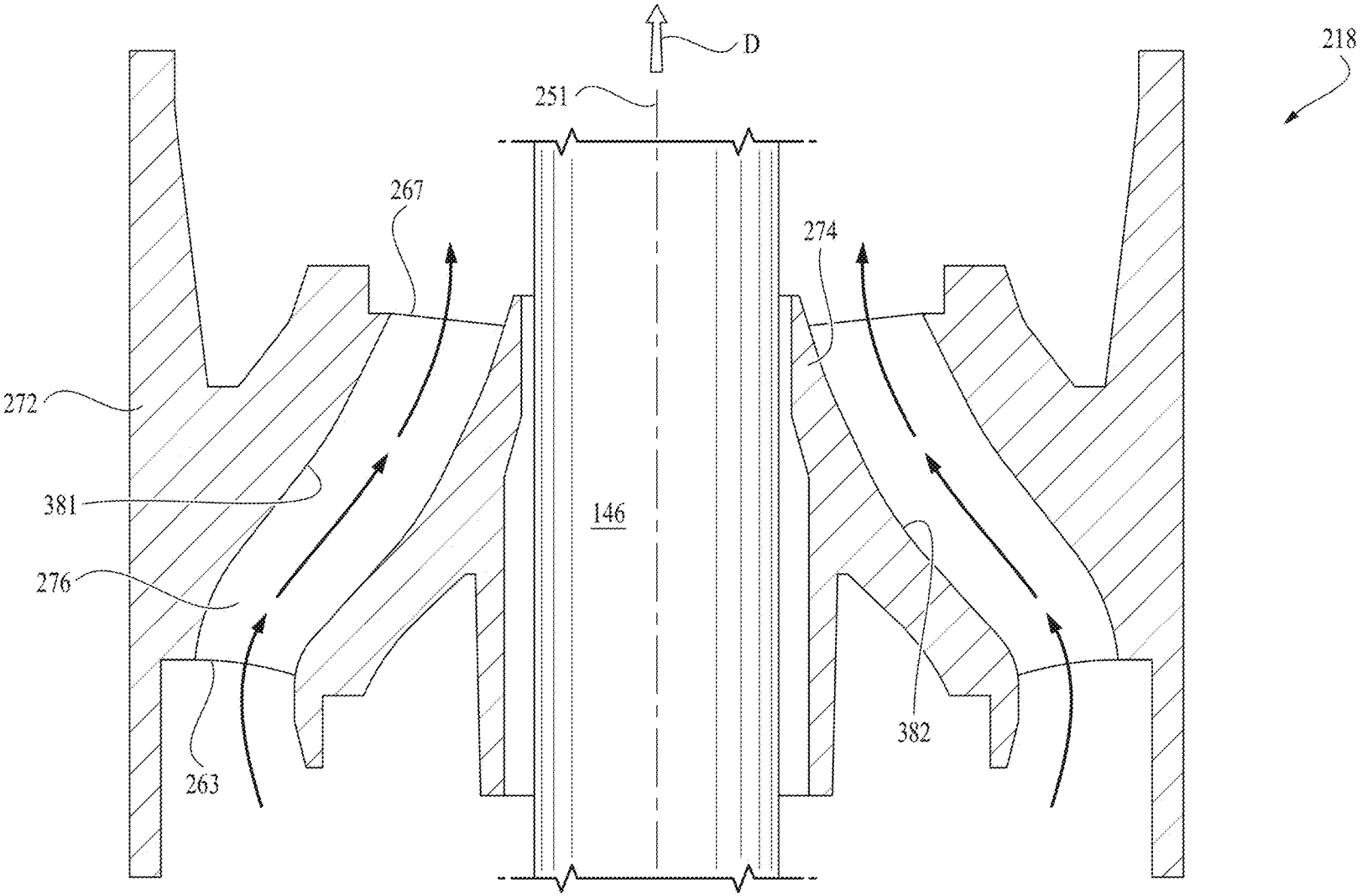
FIG. 7C is a cross-sectional side view of the diffuser of FIG. 7A.
Figure 8:
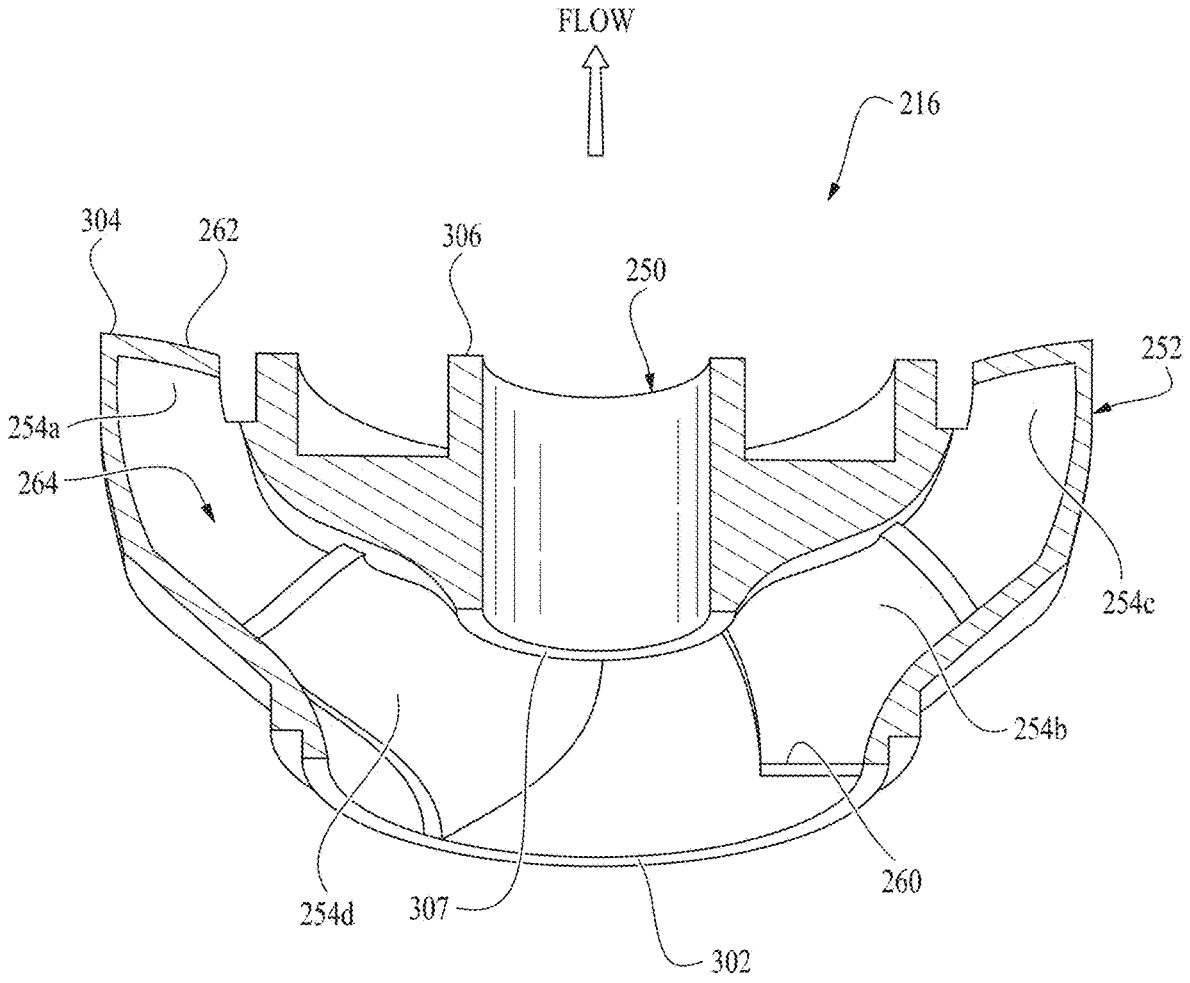
FIG. 8 is cross-sectional perspective view of the impeller of FIG. 7A.
Figure 9:
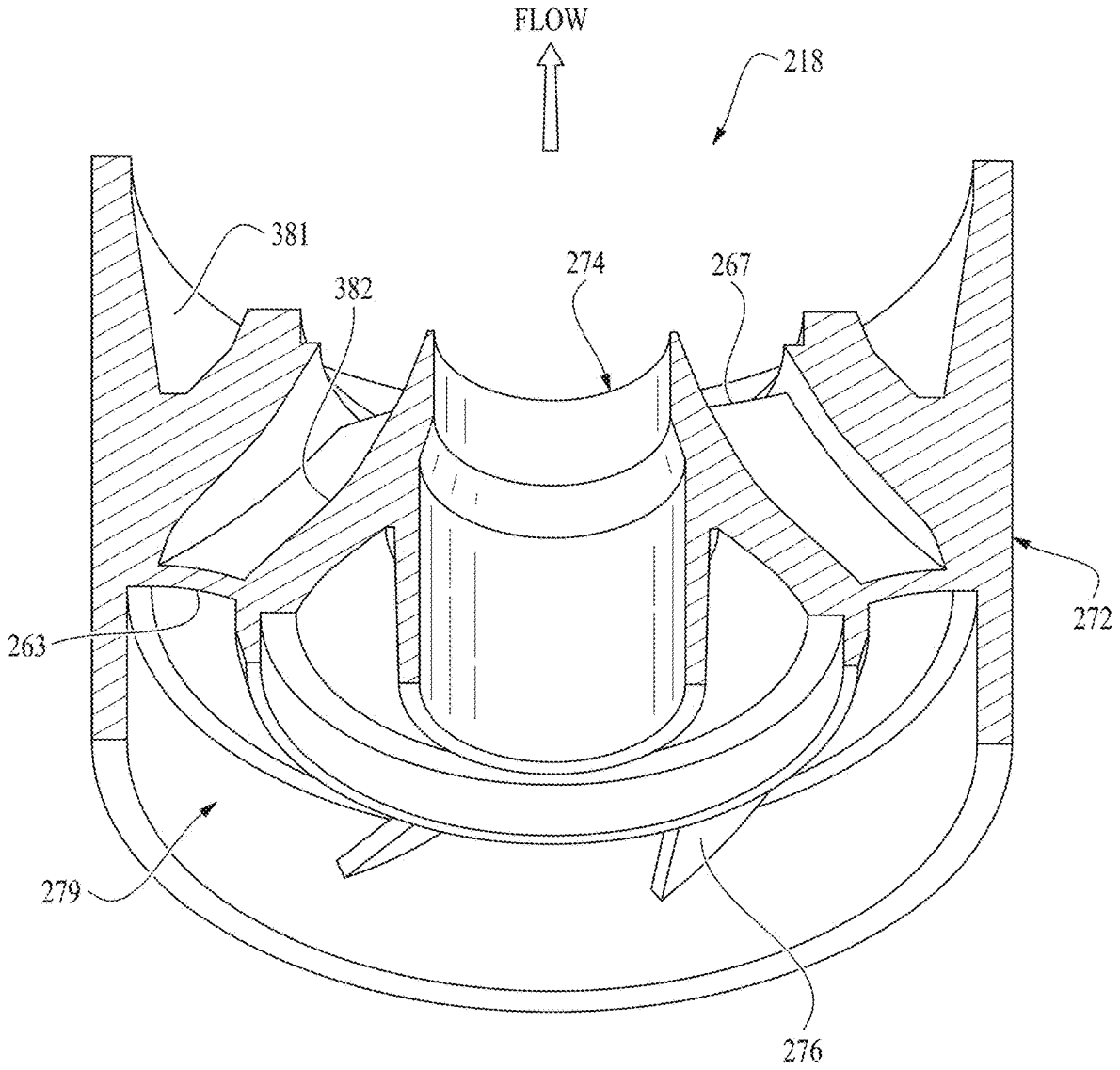
FIG. 9 is a cross-sectional perspective view of the diffuser of FIG. 7A.

In the embodiment of FIGS. 3-6, the leading edge 263 of the diffuser vane 276 is disposed inside the impeller 216. For example, the leading edge 263 of the diffuser vane 276 may be disposed between the shroud 252 of the impeller 216 and the hub 250 of the impeller 216 and/or between the first virtual plane P1 and the second virtual plane P2. In addition, the second axial end 304 may be disposed farther in the direction D than the leading edge 263 of the diffuser vane 276. Also, the trailing edge 262 of the impeller vane 254 may be disposed between the shroud 252 of the impeller 216 and the hub 250 of the impeller 216 and/or between the first virtual plane P1 and the second virtual plane P2. The advantage of this configuration is that the rotating first shroud 252 of the impeller 216 experiences the relative velocity of the solid particles experiencing the centrifugal force due to acceleration, and relative velocity has a smaller magnitude compared to absolute velocity and hence there is smaller erosion and abrasive wear. In contrast, in the embodiment of FIGS. 7-9, the leading edge 263 of the diffuser vane 276 may be disposed within the diffuser 218. For example, the leading edge 263 of the diffuser vane 276 may be disposed between the shroud 272 of the diffuser 218 and the hub 274 of the diffuser 218 and/or outside of the volume between the first virtual plane P1 and the second virtual plane P2. In addition, the leading edge 263 of the diffuser vane 276 may be disposed farther in the direction D than the second axial end 304. Also, the leading edge 262 of the impeller vane 254 may be disposed between the shroud 272 of the diffuser 218 and the hub 274 of the diffuser 218 and/or at least partially outside the volume between the first virtual plane P1 and the second virtual plane P2. This alternate configuration is based on the application requirements, flow rates, rotating speed, and diameters. In some applications being smaller diameter higher head is required, longer vanes are required due to diameter limitations and vanes are further extended.

Figure 10:
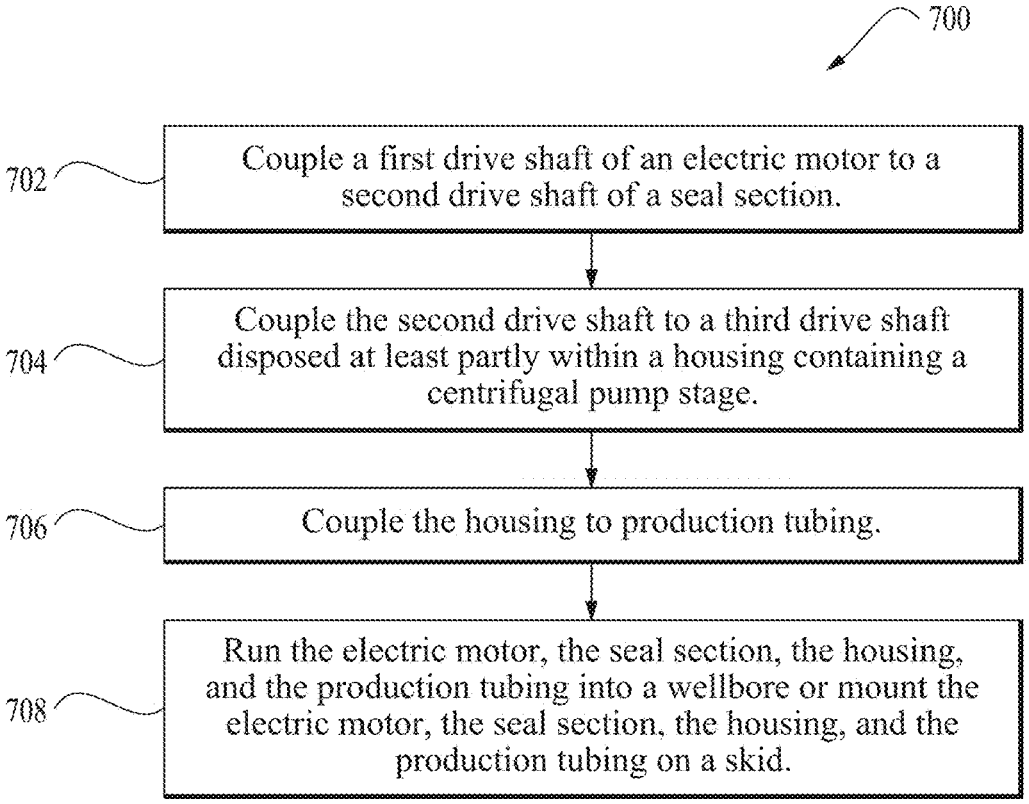
FIG. 10 is a flow diagram of an exemplary method of assembling an electric pump, according to an embodiment.

Referring to FIG. 10, a method 700 of assembling an electric submersible pump may include the step 702 of coupling a first drive shaft of an electric motor to a second drive shaft of a seal section; and the step 704 of coupling the second drive shaft to a third drive shaft disposed at least partly within a housing containing a centrifugal pump stage. The centrifugal pump stage may include an impeller rotationally coupled to the third drive shaft. The impeller may include a first hub and a first shroud concentrically disposed about the first hub and comprising a first axial end and a second axial end. The second axial end may be disposed radially outward with respect to the first axial end. A slope of an interior surface 361 of the first shroud proximate the second axial end may be parallel to a longitudinal axis of the shaft and/or may be within 20 degrees of being parallel to the longitudinal axis of the shaft. First vanes may extend from the first hub to the first shroud. A diffuser may be fluidly coupled to the impeller and may include a second hub, a second shroud concentrically disposed about the second hub, and second vanes extending from the second hub to the second shroud. The method 700 may further include coupling the housing to production tubing. The method 700 may further include the step 706 of coupling the housing to production tubing, and the step 708 of running the electric motor, the seal section, the housing, and the production tubing into a wellbore or mounting the electric motor, the seal section, the housing, and the production tubing on a skid.

Figure 11:
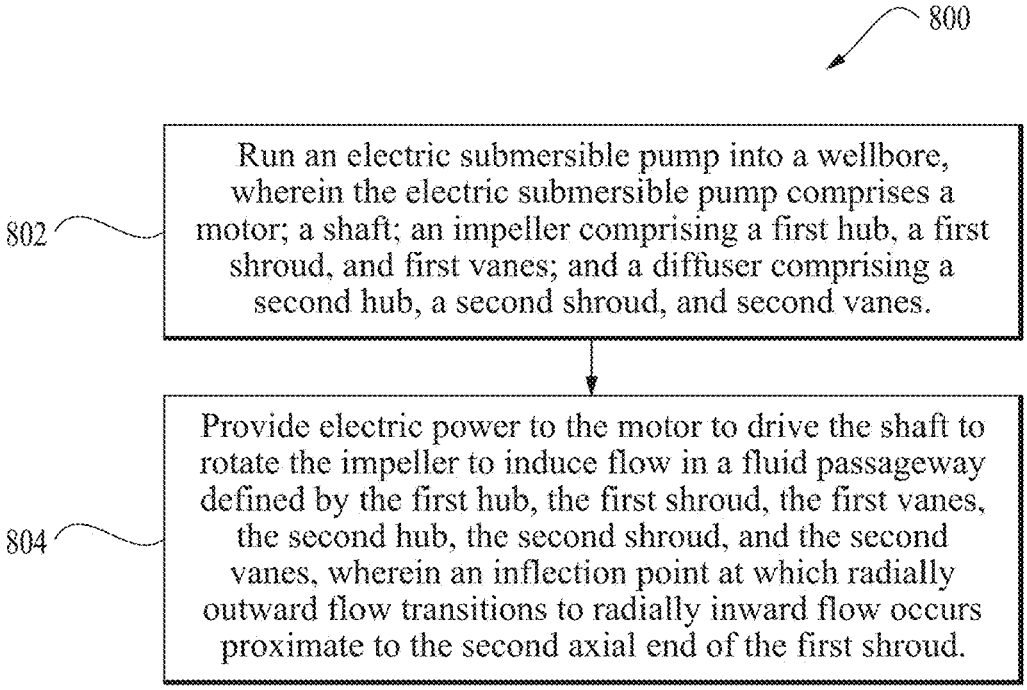
FIG. 11 is a flow diagram of an exemplary method of lifting fluid in a wellbore, according to an embodiment.

Referring to FIG. 11, a method 800 of lifting fluid in a wellbore may include the step 802 of running an electric submersible pump comprising a first hub, a first shroud, first vanes, a second hub, a second shroud, and second vanes into a wellbore, and the step 804 of providing electric power to the motor to drive the shaft to rotate the impeller to induce flow in a fluid passageway defined by the first hub, the first shroud, the first vanes, the second hub, the second shroud, and the second vanes, wherein an inflection point at which radially outward flow transitions to radially inward flow occurs proximate to a second axial end of the first shroud. The electric submersible pump may include a shaft; a motor mechanically coupled to the shaft; and an impeller rotationally coupled to the shaft. The impeller may include the first hub and the first shroud concentrically disposed about the first hub. The first shroud may comprise a first axial end and the second axial end. The second axial end may be disposed radially outward with respect to the first axial end. The first vanes may extend from the first hub to the first shroud. A diffuser may be fluidly coupled to the impeller and may include the second hub, the second shroud concentrically disposed about the second hub, and the second vanes extending from the second hub to the second shroud. The flow between the first hub and the first shroud may transition from a first velocity having a first axial component and a first radial component to a second velocity having a second axial component and a second radial component such that a magnitude of the first radial component may be within 20% of a magnitude of the first axial component. A magnitude of the second radial component may be less than 15% of a magnitude of the second axial component. The transition from the first velocity to the second velocity may occur between a first virtual plane disposed at the first axial end and perpendicular to the longitudinal axis and a second virtual plane disposed at the second axial end and perpendicular to a longitudinal axis of the shaft. The flow may impinge on the first shroud. Flow entering a volume between the second hub and the second shroud may have a velocity including a radial component and an axial component such that the magnitude of the radial component is be less than 15% of the magnitude of the axial component. In some embodiments, the impeller rotates at 3500 rpm.

The centrifugal pump according to the present disclosure may present the advantage in that the flow path is directed within the vanes to mitigate the effect of sand impingement as it comes into contact with the diffuser. This configuration of the impeller may allow the fluids to be directed into an approximately axially direction at the opening of the diffuser so as to mitigate sand blasting on the diffuser by particulates carried by the fluid. In particular, the inventors have surprisingly discovered that having the slope of the interior surface of the first shroud proximate the second axial end be within 20 degrees of parallel with respect to the longitudinal axis of the shaft may reduce erosion by the cubical rate the ratio of the velocities (i.e., relative velocity Vr to the absolute velocity Va, as shown in FIG. 12) as compared with the conventional centrifugal pumps. The curved configuration of the impeller may also improve efficiency of the pump because it may reduce frictional losses in the fluid. For example, the electric submersible pump according to the present disclosure may have up to 10 percentage point improvement in efficiency as compared with conventional centrifugal pumps.

ADDITIONAL DISCLOSURE

The following are non-limiting, specific embodiments in accordance with the present disclosure:

In a first embodiment, an electric submersible pump comprises a shaft; a motor mechanically coupled to the shaft; an impeller rotationally coupled to the shaft, wherein the impeller comprises: a first hub; a first shroud concentrically disposed about the first hub and comprising a first axial end and a second axial end, wherein the second axial end is disposed radially outward with respect to the first axial end, and wherein a slope of an interior surface of the first shroud proximate the second axial end is within 20 degrees of being parallel to a longitudinal axis of the shaft; and first vanes extending from the first hub to the first shroud; and a diffuser fluidly coupled to the impeller and comprising: a second hub; a second shroud concentrically disposed about the second hub; and second vanes extending from the second hub to the second shroud.

A second embodiment can include the electric submersible pump of the first embodiment, wherein the impeller is configured to rotate with respect to the diffuser, which is stationary.

A third embodiment can include the electric submersible pump of the first or second embodiments, wherein the impeller is concentrically disposed with respect to the diffuser.

A fourth embodiment can include the electric submersible pump of any of the first through third embodiments, wherein the first vanes comprise a trailing edge, the second axial end is disposed farther in a direction parallel to the longitudinal axis than the first axial end, and the second axial end is disposed farther in the direction than the trailing edge.

A fifth embodiment can include the electric submersible pump of any of the first through fourth embodiments, wherein the second vanes comprise a leading edge, the second axial end is disposed farther in a direction parallel to the longitudinal axis than the first axial end, and the second axial end is disposed farther in the direction than the leading edge.

A sixth embodiment can include the electric submersible pump of any of the first through fifth embodiments, wherein the second vanes comprise a leading edge, the second axial end is disposed farther in a direction parallel to the longitudinal axis than the first axial end, and the leading edge is disposed farther in the direction than the second axial end.

A seventh embodiment can include the electric submersible pump of any of the first through sixth embodiments, wherein the first hub comprises a first axial end and a second axial end, the second axial end of the first shroud is disposed on a virtual plane perpendicular to the longitudinal axis, and the second axial end of the first hub is disposed on or proximate to the virtual plane, and wherein the second axial end of the first shroud is disposed farther in the direction than the second axial end of the first hub.

An eighth embodiment can include the electric submersible pump of any of the first through seventh embodiments, wherein the first vanes comprise a leading edge, the second vanes comprise a trailing edge, and the leading edge is disposed proximate to the trailing edge.

A ninth embodiment can include the electric submersible pump of any of the first through eighth embodiments, wherein a profile of the leading edge corresponds in shape with a profile of the trailing edge.

A tenth embodiment can include the electric submersible pump of any of the first through ninth embodiments, wherein the impeller is disposed inside a volume defined by the diffuser and another diffuser.

An eleventh embodiment can include the electric submersible pump of any of the first through tenth embodiments, wherein the first hub is disposed at least partially inside the second hub, and the first shroud is disposed at least partially inside the second shroud.

In a twelfth embodiment, a method of assembling an electric pump comprises coupling a first drive shaft of an electric motor to a second drive shaft of a seal section; and coupling the second drive shaft to a third drive shaft disposed at least partly within a housing containing a centrifugal pump stage, wherein the centrifugal pump stage comprises: an impeller rotationally coupled to the third drive shaft, wherein the impeller comprises: a first hub; a first shroud concentrically disposed about the first hub and comprising a first axial end and a second axial end, wherein the second axial end is disposed radially outward with respect to the first axial end, and wherein a slope of an interior surface of the first shroud proximate the second axial end is within 20 degrees of being parallel to a longitudinal axis of the third drive shaft; and first vanes extending from the first hub to the first shroud; and a diffuser fluidly coupled to the impeller and comprising: a second hub; a second shroud concentrically disposed about the second hub; and second vanes extending from the second hub to the second shroud.

A thirteenth embodiment can include the method of the twelfth embodiment, further comprising coupling the housing to production tubing.

A fourteenth embodiment can include the method of the twelfth or thirteen embodiments, further comprising running the electric motor, the seal section, the housing, and the production tubing into a wellbore.

A fifteenth embodiment can include the method of any of the twelfth or fourteenth embodiments, further comprising mounting the electric motor, the seal section, the housing, and the production tubing on a skid.

In a sixteenth embodiment, a method of lifting fluid in a wellbore comprises running an electric submersible pump into a wellbore, wherein the electric submersible pump comprises: a shaft; a motor mechanically coupled to the shaft; an impeller rotationally coupled to the shaft, wherein the impeller comprises: a first hub; a first shroud concentrically disposed about the first hub and comprising a first axial end and a second axial end, wherein the second axial end is disposed radially outward with respect to the first axial end; and first vanes extending from the first hub to the first shroud; and a diffuser fluidly coupled to the impeller and comprising: a second hub; a second shroud concentrically disposed about the second hub; and second vanes extending from the second hub to the second shroud; and providing electric power to the motor to drive the shaft to rotate the impeller to induce flow in a fluid passageway defined by the first hub, the first shroud, the first vanes, the second hub, the second shroud, and the second vanes, wherein an inflection point at which radially outward flow transitions to radially inward flow occurs proximate to the second axial end.

A seventeenth embodiment can include the method of the sixteenth embodiment, wherein the flow between the first hub and the first shroud transitions from a first velocity having a first axial component and a first radial component to a second velocity having a second axial component and a second radial component, a magnitude of the first radial component is within +20% of a magnitude of the first axial component, and a magnitude of the second radial component is less than 15% of a magnitude of the second axial component.

An eighteenth embodiment can include the method of the sixteenth or seventeenth embodiments, wherein the transition from the first velocity to the second velocity occurs between a first virtual plane disposed at the first axial end and perpendicular to a longitudinal axis of the shaft and a second virtual plane disposed at the second axial end and perpendicular to the longitudinal axis.

A nineteenth embodiment can include the method of any of the sixteenth through eighteenth embodiments, wherein the flow impinges on the first shroud.

A twentieth embodiment can include the method of any of the sixteenth through nineteenth embodiments, wherein flow entering a volume between the second hub and the second shroud has a velocity comprising a radial component and an axial component, and a magnitude of the radial component is less than 15% of the magnitude of the axial component.

In a twenty-first embodiment, an electric submersible pump comprises a diffuser and an impeller in fluid communication with the diffuser, the impeller having a radial flow portion upstream of an axial flow portion, wherein an axial length of the axial flow portion is equal to or greater than an axial length of the radial flow portion and/or wherein the radial flow portion has a smaller radius of curvature compared to a radius of curvature of the axial flow portion.

In a twenty-second embodiment, a method of lifting fluid in a well comprises redirecting fluid flow within the flow passages of an impeller to eliminate radial flow by a radiused outer wall of the impeller.

A twenty-third embodiment can include the method of the twenty-second embodiment, wherein the radial flow of the fluid is eliminated before the fluid enters a diffuser.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either element from the set {A, B}, including multiples of any either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the terms "a" and "an" mean "one or more." As used herein, the term "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. An electric submersible pump, comprising:
a shaft;
a motor mechanically coupled to the shaft;
an impeller rotationally coupled to the shaft, wherein the impeller comprises:
a first hub;
a first shroud concentrically disposed about the first hub and comprising a first axial end and a second axial end, wherein the second axial end is disposed radially outward with respect to the first axial end; and
first vanes extending from the first hub to the first shroud; and
a diffuser fluidly coupled to the impeller and comprising:
a second hub;
a second shroud concentrically disposed about the second hub; and
second vanes extending from the second hub to the second shroud,
wherein a slope of an interior surface of the first shroud proximate the second axial end is within 20 degrees of being parallel to a longitudinal axis of the shaft so that when the impeller rotates, flow entering a volume between the second hub and the second shroud has a velocity comprising a radial component and an axial component, and a magnitude of the radial component is less than 15% of the magnitude of the axial component.

2. The electric submersible pump of claim 1, wherein the impeller is configured to rotate with respect to the diffuser, which is stationary.

3. The electric submersible pump of claim 1, wherein the impeller is concentrically disposed with respect to the diffuser.

4. The electric submersible pump of claim 1, wherein the first vanes comprise a trailing edge.

5. The electric submersible pump of claim 1, wherein the second vanes comprise a leading edge.

6. The electric submersible pump of claim 4, wherein the second vanes further comprise a leading edge.

7. The electric submersible pump of claim 1, wherein
the first hub comprises a first axial end and a second axial end,
the second axial end of the first shroud is disposed on a virtual plane perpendicular to the longitudinal axis, and
the second axial end of the first hub is disposed proximate to the virtual plane.

8. The electric submersible pump of claim 1, wherein the first vanes comprise a leading edge, the second vanes comprise a trailing edge, and the leading edge is disposed proximate to the trailing edge.

9. The electric submersible pump of claim 8, wherein a profile of the leading edge corresponds in shape with a profile of the trailing edge.

10. The electric submersible pump of claim 1, wherein the impeller is disposed inside a volume defined by the diffuser and another diffuser.

11. The electric submersible pump of claim 1, wherein the first hub is disposed at least partially inside the second hub, and the first shroud is disposed at least partially inside the second shroud.

12. A method of assembling an electric pump, comprising:
coupling a first drive shaft of an electric motor to a second drive shaft of a seal section; and
coupling the second drive shaft to a third drive shaft disposed at least partly within a housing containing a centrifugal pump stage, wherein the centrifugal pump stage comprises:
an impeller rotationally coupled to the third drive shaft, wherein the impeller comprises:
a first hub;
a first shroud concentrically disposed about the first hub and comprising a first axial end and a second axial end, wherein the second axial end is disposed radially outward with respect to the first axial end; and first vanes extending from the first hub to the first shroud; and a diffuser fluidly coupled to the impeller and comprising:

a second hub;

a second shroud concentrically disposed about the second hub; and second vanes extending from the second hub to the second shroud, wherein a slope of an interior surface of the first shroud proximate the second axial end is within 20 degrees of being parallel to a longitudinal axis of the third drive shaft so that when the impeller rotates, flow entering a volume between the second hub and the second shroud has a velocity comprising a radial component and an axial component, and a magnitude of the radial component is less than 15% of the magnitude of the axial component.

13. The method of claim 12, further comprising coupling the housing to production tubing.

14. The method of claim 13, further comprising running the electric motor, the seal section, the housing, and the production tubing into a wellbore.

15. The method of claim 13, further comprising mounting the electric motor, the seal section, the housing, and the production tubing on a skid.

16. A method of lifting fluid in a wellbore, comprising:

running an electric submersible pump into a wellbore, wherein the electric submersible pump comprises:

a shaft;

a motor mechanically coupled to the shaft;

an impeller rotationally coupled to the shaft, wherein the impeller comprises:

a first hub;

a first shroud concentrically disposed about the first hub and comprising a first axial end and a second axial end, wherein the second axial end is disposed radially outward with respect to the first axial end; and first vanes extending from the first hub to the first shroud; and a diffuser fluidly coupled to the impeller and comprising:

a second hub;

a second shroud concentrically disposed about the second hub; and second vanes extending from the second hub to the second shroud; and providing electric power to the motor to drive the shaft to rotate the impeller to induce flow in a fluid passageway defined by the first hub, the first shroud, the first vanes, the second hub, the second shroud, and the second vanes, wherein an inflection point at which radially outward flow transitions to radially inward flow occurs proximate to the second axial end, wherein flow entering a volume between the second hub and the second shroud has a velocity comprising a radial component and an axial component, and wherein a magnitude of the radial component is less than 15% of the magnitude of the axial component.

17. The method of claim 16, wherein a radial component of the flow in the fluid passageway decreases moving from a leading edge of the first vanes to a trailing edge of the first vanes.

18. The method of claim 16, wherein the inflection point occurs between a first virtual plane disposed at the first axial end and perpendicular to a longitudinal axis of the shaft and a second virtual plane disposed at the second axial end and perpendicular to the longitudinal axis.

19. The method of claim 16, wherein the flow impinges on the first shroud.

20. The method of claim 16, wherein a slope of an interior surface of the first shroud proximate the second axial end is within 20 degrees of being parallel to a longitudinal axis of the shaft.

* * * * *